US008861755B2

(12) United States Patent
Ando et al.

(10) Patent No.: US 8,861,755 B2
(45) Date of Patent: Oct. 14, 2014

(54) PIEZOELECTRIC SPEAKER

(71) Applicant: Murata Manufacturing Co., Ltd., Nagaokakyo (JP)

(72) Inventors: Masamichi Ando, Nagaokakyo (JP); Hideki Kawamura, Nagaokakyo (JP)

(73) Assignee: Murata Manufacturing Co., Ltd., Nagaokakyo-Shi, Kyoto-fu (JP)

( * ) Notice: Subject to any disclaimer, the term of this patent is extended or adjusted under 35 U.S.C. 154(b) by 0 days.

(21) Appl. No.: 13/958,870

(22) Filed: Aug. 5, 2013

(65) Prior Publication Data

US 2014/0119576 A1 May 1, 2014

Related U.S. Application Data

(63) Continuation of application No. PCT/JP2012/052810, filed on Feb. 8, 2012.

(30) Foreign Application Priority Data

Feb. 9, 2011 (JP) ..... 2011-025528

(51) Int. Cl.
*H04R 17/00* (2006.01)
*H04R 1/22* (2006.01)

(52) U.S. Cl.
CPC ..... *H04R 17/005* (2013.01); *H04R 1/227* (2013.01)
USPC ..... 381/190; 381/191

(58) Field of Classification Search
CPC ..... H04R 17/00; H04R 17/005; H04R 17/10
USPC ..... 381/190, 191, 152, 173–176, 184, 398, 381/423, 426; 181/170–172
See application file for complete search history.

(56) References Cited

U.S. PATENT DOCUMENTS

| | | | | |
|---|---|---|---|---|
| 6,427,017 | B1 * | 7/2002 | Toki | 381/190 |
| 6,912,288 | B2 * | 6/2005 | Nakashima et al. | 381/190 |
| 8,363,863 | B2 | 1/2013 | Andoh et al. | |
| 2002/0176592 | A1 * | 11/2002 | Howarth et al. | 381/190 |
| 2008/0019544 | A1 * | 1/2008 | Ogura et al. | 381/190 |
| 2009/0154735 | A1 * | 6/2009 | Kim et al. | 381/190 |

FOREIGN PATENT DOCUMENTS

| | | | |
|---|---|---|---|
| JP | 2004-266643 | A | 9/2004 |
| JP | 2004-364334 | A | 12/2004 |
| JP | 2009-272978 | A | 11/2009 |
| WO | WO-2009/144964 | A1 | 12/2009 |

OTHER PUBLICATIONS

PCT/JP2012/052810 Written Opinion dated Mar. 27, 2012.

* cited by examiner

*Primary Examiner* — Tuan D Nguyen
(74) *Attorney, Agent, or Firm* — Dickstein Shapiro LLP

(57) ABSTRACT

A piezoelectric speaker that includes a configuration in which a first piezoelectric speaker and a second piezoelectric speaker are respectively arranged adjacent primary surfaces of a plate-shaped base member. The first piezoelectric speaker and the second piezoelectric speaker have the same arrangement, and respective individual piezoelectric elements thereof are arranged so as to correspond to each other when viewed from the direction orthogonal to the primary surfaces of the base member. The first and second piezoelectric speakers include a piezoelectric polymer sheet and electrode patterns of substantially the same shape on both surfaces of the polymer sheet. According to this arrangement, plural individual piezoelectric elements are aligned with each other. A single type of acoustic driving signal is supplied to these plural individual piezoelectric elements in a synchronized manner.

20 Claims, 24 Drawing Sheets

FIG. 8C - PRIOR ART

PIEZOELECTRIC SPEAKER

CROSS REFERENCE TO RELATED APPLICATIONS

The present application is a continuation of International application No. PCT/JP2012/052810, filed Feb. 8, 2012, which claims priority to Japanese Patent Application No. 2011-025528, filed Feb. 9, 2011, the entire contents of each of which are incorporated herein by reference.

FIELD OF THE INVENTION

The present invention relates to a piezoelectric speaker formed with a piezoelectric polymer sheet.

BACKGROUND OF THE INVENTION

Conventionally, various types of substantially plate-shaped piezoelectric speakers in which a piezoelectric polymer sheet is used have been proposed. The piezoelectric speakers with a piezoelectric polymer sheet have, for example, a piezoelectric polymer sheet and opposing electrodes formed on both sides of the piezoelectric polymer sheet, such as a flexible speaker disclosed in Patent Document 1. In response that a voltage is applied between the opposing electrodes, an electric field works on the piezoelectric polymer sheet, and the piezoelectric polymer sheet distorts. This distortion is utilized to generate a sound.

Patent Document 1: Japanese Laid-open Patent Publication No. 2009-272978

SUMMARY OF THE INVENTION

In the piezoelectric speaker with the piezoelectric polymer sheet as disclosed in Patent Document 1 described above, however, while the sound emitting surface of the piezoelectric polymer sheet is bent to efficiently emit the sound, the plate-shaped sound emitting surface of the piezoelectric polymer sheet is likely to cause the reduction in the sound pressure. It is noted that the plate-shaped sound emitting surface refers to a shape that the sound emitting surface, that is, the primary surface of the piezoelectric polymer sheet expands two-dimensionally only. That is, it does not refer to the shapes that expand three-dimensionally such as a corn type, a dome type, and a horn type used in general three-dimensional speakers.

Therefore, the purpose of the present invention is to realize a piezoelectric speaker that is able to emit sounds with a higher sound pressure than the conventional one even if the sound emitting surface is plate-shaped.

The present invention relates to a piezoelectric speaker including a piezoelectric polymer sheet and electrodes formed on both opposing primary surfaces of the polymer sheet and adapted to apply an electric field to the polymer sheet. In this piezoelectric speaker, plural individual piezoelectric elements that individually vibrate by a single acoustic driving signal are formed according to an electrode pattern formed on the polymer sheet.

In this arrangement, plural individual piezoelectric elements that individually vibrate are formed using a single polymer sheet. The substantially synchronized sound emission by the single acoustic driving signal using the plural individual piezoelectric elements allows for the improved sound pressure level compared to the case where a single individual piezoelectric element expanding over the entire polymer sheet as illustrated in FIG. 8C under the condition of the same area and the same driving signal level. Also, frequency characteristics, in particular, frequency characteristics in an audible range above approximately 1000 Hz are improved.

Further, the piezoelectric speaker of this invention preferably has the following arrangement. The piezoelectric speaker includes two polymer sheets on which plural individual piezoelectric elements are formed and a plate-shaped base member. Then, in this piezoelectric speaker, the two polymer sheets are arranged so as to hold the base member therebetween such that individual piezoelectric elements formed on the respective two polymer sheets substantially correspond to each other when viewed from the direction orthogonal to the primary surface.

This arrangement allows for an enhanced sound pressure level to improve frequency characteristics.

Further, in the piezoelectric speaker of the present invention, the surfaces opposite to the base member in two polymer sheets are preferably arranged with protection sheets having a shape covering the electrodes of the individual piezoelectric elements.

This arrangement allows for protecting the electrodes, that is, the individual piezoelectric elements from an external environment and an impact from outside and for weakening the resonance peak of the sound that is emitted from each individual piezoelectric element to have flatter frequency characteristics.

Further, in the piezoelectric speaker of the present invention, it is preferable to include a holding member adapted to hold the base member and vibrate by a driving signal, and a driving unit adapted to apply particular sound range components to the holding member.

In this arrangement, the vibration of the holding member causes a laminated plate of the two polymer sheets and the base member to vibrate and emit sound. This allows for a particular sound range component of the emitted sound (for example, lower sound range components ranging from a few Hz to a few tens Hz) to be increased, so that more excellent frequency characteristics can be realized.

Further, the piezoelectric speaker of the present invention preferably has the following arrangement. The electrode of the individual piezoelectric element is divided into four by a first dividing line along the longitudinal direction of a polymer sheet and a second dividing line orthogonal to the first dividing line. Further, each divided electrode is further divided into two, one of which is an inner side electrode arranged in the center side of the individual piezoelectric element and the other is an outer side electrode arranged in the peripheral region of the individual piezoelectric element.

In this arrangement, the individual piezoelectric element is further divided into an inner circumference side and an outer circumference side, so that frequency characteristics of the sound pressure level is further improved.

Further, the piezoelectric speaker of the present invention may have the following arrangement.

Shapes of the inner side electrode and the outer side electrode of at least one individual piezoelectric element of the plural individual piezoelectric elements are different from shapes of the inner side electrode and the outer side electrode of other individual piezoelectric element.

An area ratio of the inner side electrode to the outer side electrode of at least one individual piezoelectric element of the plural individual piezoelectric elements is different from an area ratio of the inner side electrode to the outer side electrode of other individual piezoelectric element.

The dividing line that divides the inner side electrode and the outer side electrode is an asteroid curve that is convex toward the intersection.

These arrangements allow for realizing more various frequency characteristics even with a polymer sheet having the same area and with the same driving signal.

Further, in the piezoelectric speaker of the present invention, the primary component of the polymer sheet is preferably polylactic acid of L-isomer.

This arrangement allows for a piezoelectric speaker which is superior to other polymer sheets in piezoelectricity and superior in terms of the global environment preservation. Further, when other members are made of a transparent material to form a transparent speaker, it is superior to other polymer sheets in the transmittance.

Further, in the piezoelectric speaker of the present invention, it is preferable that the electrode is a transparent electrode and the refractive index of the transparent electrode and that of the polymer sheets are substantially the same.

This arrangement allows for realizing a transparent speaker.

Further, in the piezoelectric speaker of the present invention, it is preferable to form the transparent electrode with at least one of indium tin oxide, indium zinc oxide, and zinc oxide as the primary component.

In this arrangement, the transparent electrode formed on the polymer sheet can be easily formed by a conventional manufacturing method for a transparent electrode.

Further, in the piezoelectric speaker in the present invention, the transparent electrode is preferably formed with at least one of polythiophene and polyaniline as the primary component.

In this arrangement, the transparent electrode may be formed while the polymer sheet is being conveyed.

Further, in the piezoelectric speaker in the present invention, the individual piezoelectric elements are preferably aligned such that at least four of them are in the longitudinal direction and at least two of them are in the short direction with respect to the polymer sheet.

As such, eight or more individual piezoelectric elements are aligned and formed, so that desired frequency characteristics can be more easily realized.

According to the present invention, a piezoelectric speaker can be realized that is able to emit sound with a higher sound pressure than the conventional one even if the sound emitting surface is plate-shaped.

BRIEF EXPLANATION OF THE DRAWINGS

FIG. 8C represents a view comparing the sound pressure level to frequency characteristics in the arrangement of the first embodiment with that in the single individual piezoelectric element.

DETAILED DESCRIPTION OF THE INVENTION

Figure 1:
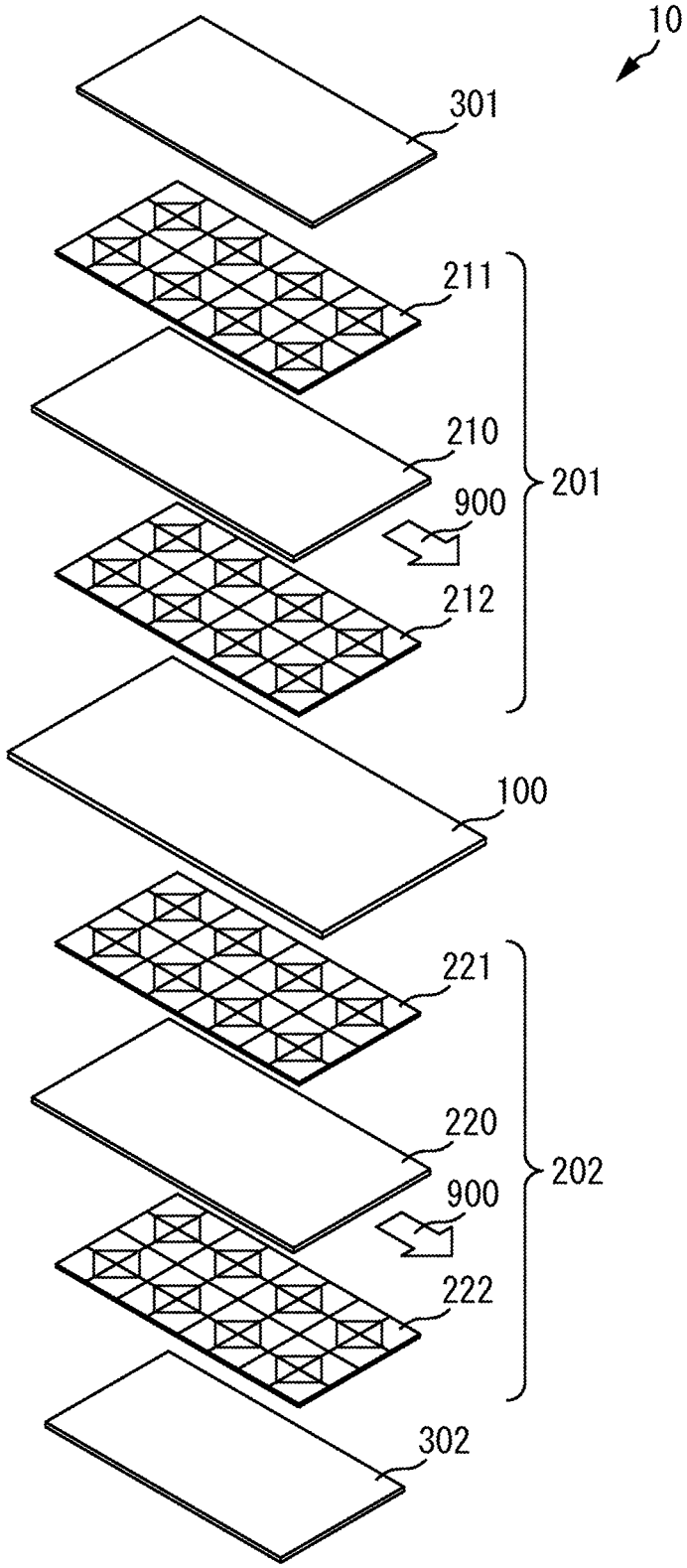
FIG. 1 is an exploded perspective view illustrating an arrangement of a piezoelectric speaker 10 according to a first embodiment.
Figure 2:
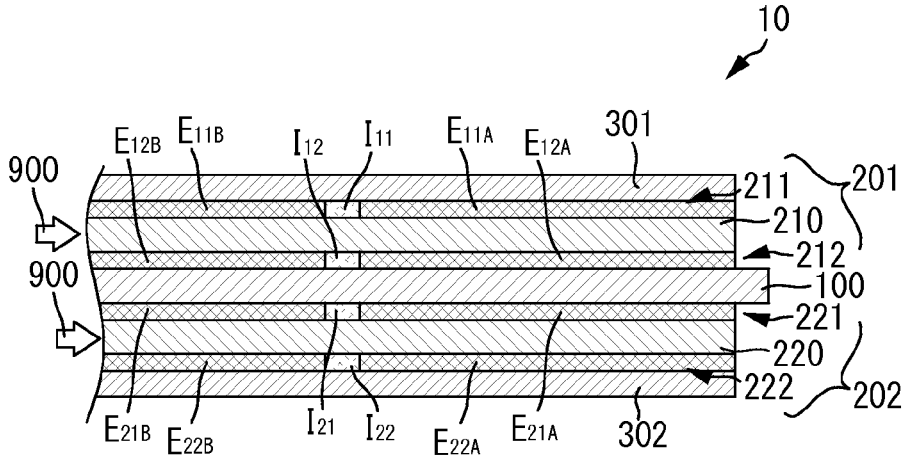
FIG. 2 is a partial cross-sectional side view illustrating an arrangement of a piezoelectric speaker 10 according to the first embodiment.

A piezoelectric speaker according to a first embodiment of the present invention will be described by referring to the drawings. FIG. 1 is an exploded perspective view illustrating the arrangement of a piezoelectric speaker 10 according to the first embodiment. FIG. 2 is a partial cross-sectional side view illustrating the arrangement of the piezoelectric speaker 10 according to the first embodiment. It is noted that, in FIG. 1 and FIG. 2, the depiction is omitted for the wiring electrode through which acoustic driving signals are inputted for applying an electric field to the piezoelectric polymer sheets 210 and 220 of the first and second piezoelectric speakers 201 and 202. Further, the adhesive agent and the like for adhering respective layers are omitted in FIG. 2.

The piezoelectric speaker 10 includes a plate-shaped base member 100. The base member 100 is formed with an acrylic resin such as polymethylmethacrylate (PMMA). It is noted that the base member 100 is not limited to PMMA, but may be formed with polyethylene terephthalate (PET), polypropylene (PP). It is preferable that the use of PET or PMMA ensures a transmittance equal to or above a predetermined level. For example, the use of these materials allows for a transmittance of approximately 80% or more. Further, while the thickness of the base member 100 is preferably about 0.05 mm to about 1.0 mm, it may be changed according to the specification.

One primary surface (upper surfaces in FIG. 1 and FIG. 2) of the base member 100 is provided with a first piezoelectric speaker 201. The other primary surface (under surfaces in FIG. 1 and FIG. 2) of the base member 100 is provided with a second piezoelectric speaker 202.

While the detailed arrangement of the electrode pattern will be described later, the first piezoelectric speaker 201 and the second piezoelectric speaker 202 are flat type transparent speakers having the same structure. In general, in the first piezoelectric speaker 201, one primary surface of the polymer sheet 210 is formed with an electrode pattern 211 and the other primary surface is formed with another electrode pattern 212 having the same shape as the electrode pattern 211. Similarly, in the second piezoelectric speaker 202, one primary surface of the polymer sheet 220 is formed with an electrode pattern 221 and the other primary surface is formed with another electrode pattern 222 having the same shape as the electrode pattern 221. The electric field is applied to the polymer sheets 210 and 220 with the electric field application pattern described later via these electrode patterns 211, 212, 221, and 222, so that the polymer sheets 210 and 220 vibrate in the direction orthogonal to the primary surfaces and thus functions as a speaker.

The polymer sheets 210 and 220 are made of polylactic acid of L-isomer (PLLA), and cut out so that the extending direction corresponds to the longitudinal direction. While an organic piezoelectric sheet made of other chiral polymer may be used for the polymer sheets 210 and 220, it is desirable to use PLLA for forming a flat type transparent speaker.

Each of the electrode patterns 211, 212, 221, and 222 is formed with at least one of indium tin oxide (ITO), indium zinc oxide, and zinc oxide (ZnO) as the primary component. Each of the electrode patterns 211, 212, 221, and 222 may also be formed with an organic electrode having polythiophene as the primary component.

In this case, for the material with which each of the electrode patterns 211, 212, 221, and 222 is formed, selected may be the one with high self transmittance (for example, 80% or more as described above) and the extremely low reflectance at the interface with the polymer sheets 210 and 220 (for example, less than a few %), that is, the material having substantially the same refractive index as the polymer sheets 210 and 220. Then, the use of respective materials described above allow for the above-described flat type transparent speaker having a transmittance even when the laminated structure with the polymer sheets 210 and 220 is made of the PLLA.

The first piezoelectric speaker 201 and the second piezoelectric speaker 202 are arranged so that they are plane symmetry with respect to the base member 100, that is, so that respective individual piezoelectric elements substantially correspond to each other when viewed from the direction orthogonal to the primary surface of the base member 100. It is noted that the detailed arrangement of the individual piezoelectric elements will be described later.

A protection sheet 301 is provided on one of the primary surfaces that is opposite to the base member 100 of the first piezoelectric speaker 201. The protection sheet 301 is formed in a shape so as to cover the group of the individual piezoelectric elements of the first piezoelectric speaker 201. The protection sheet 301 is formed with any one of polyethylene terephthalate (PET), polypropylene (PP), and a similar elastomer-based material.

A protection sheet 302 is provided on one of the primary surfaces that is opposite to the base member 100 of the second piezoelectric speaker 202. The protection sheet 302 is formed in a shape so as to cover the group of the individual piezoelectric elements of the second piezoelectric speaker 202. The protection sheet 302 is formed with any one of polyethylene terephthalate (PET), polypropylene (PP), and a similar elastomer-based material as the protection sheet 301.

It is noted that, although these protection sheets 301 and 302 may be omitted, they are useful for the following points when provided.

(1) The first piezoelectric speaker 201 and the second piezoelectric speaker 202 may be protected from an external environment such as heat, moisture, and so on and may be protected from an external impact such as a contact by a user.

(2) When the first piezoelectric speaker 201 and the second piezoelectric speaker 202 emit sound by a driving signal, while a weak resonance peak is generated (see FIGS. 8A and 8Be), the protection sheets 301 and 302 serve as buffer materials so as to weaken the resonance peak. This allows for an emission of sound with flatter frequency characteristics.

According to the above arrangement, for the first piezoelectric speaker 201 and the second piezoelectric speaker 202, the opposite electric fields are applied between the electrodes which are formed at the same position when viewed from the direction orthogonal to the primary surfaces, so that a flat type so called bimorph-structured transparent piezoelectric speaker is formed.

Next, more specific arrangement of the first piezoelectric speaker 201 and the second piezoelectric speaker 202 will be described. It is noted that, as described above, since the first piezoelectric speaker 201 and the second piezoelectric speaker 202 have the same structure, the specific arrangement of the first piezoelectric speaker 201 as an example will be described below.

As described above, the first piezoelectric speaker 201 includes the polymer sheet 210, and the electric patterns 211 and 212 formed in a symmetrical manner on both primary surfaces of the polymer sheet 210.

Figure 3:
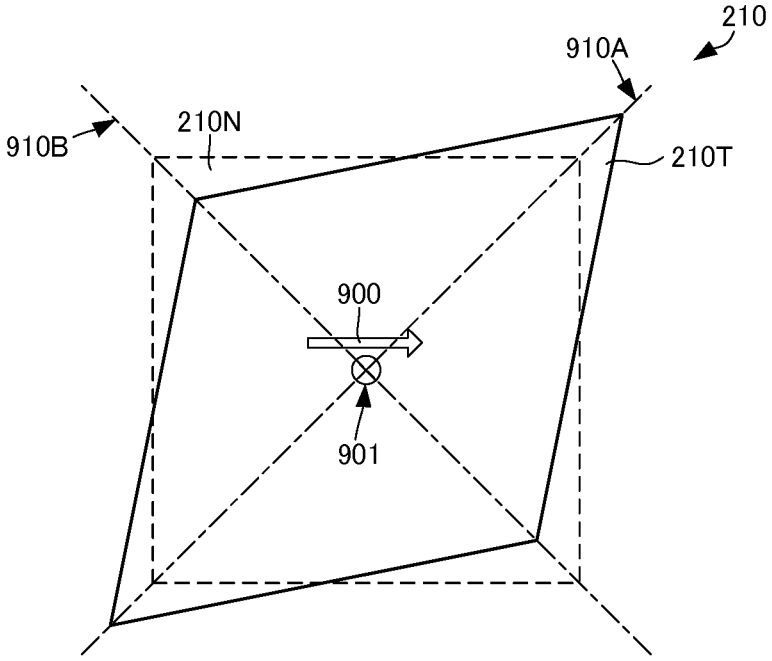
FIG. 3 is a view for illustrating piezoelectricity of a polymer sheet 210.

When being applied with an electric field, the polymer sheet 210 exhibits the movement as illustrated in FIG. 3. FIG.

3 is a view for illustrating piezoelectricity of the polymer sheet 210. It is noted that the deformation amount in FIG. 3 is depicted with exaggeration for the illustration purpose.

The polylactic acid of L-isomer (PLLA) sheet that forms the polymer sheet 210 and is extended along one axis has piezoelectricity and has tensor components of d14 and d25 as piezoelectricity distortion constants where the extending direction of the sheet is defined as a third axis, the film thickness direction orthogonal to the third axis is defined as a first axis, and the direction orthogonal to both first axis and third axis is defined as a second axis. In FIG. 3, the direction represented as the symbol 900 is defined as the third axis direction that is the extending direction, and the direction represented as the symbol 901 directed from the top to the backside of the drawing sheet is defined as the first axis direction. In this situation, the shear elasticity due to d14 causes the square PLLA sheet 210N to extend in the direction that substantially corresponds to the diagonal line 910A and contract in the direction that substantially corresponds to the diagonal line 910B orthogonal to the diagonal line 910A, and therefore deforms in the a diamond shape such as a sheet shape 210T in FIG. 3.

The PLLA sheet having such piezoelectric property is cut out so that its extending direction corresponds to the longitudinal direction, so that the polymer sheet 210 is formed.

Figure 4A:
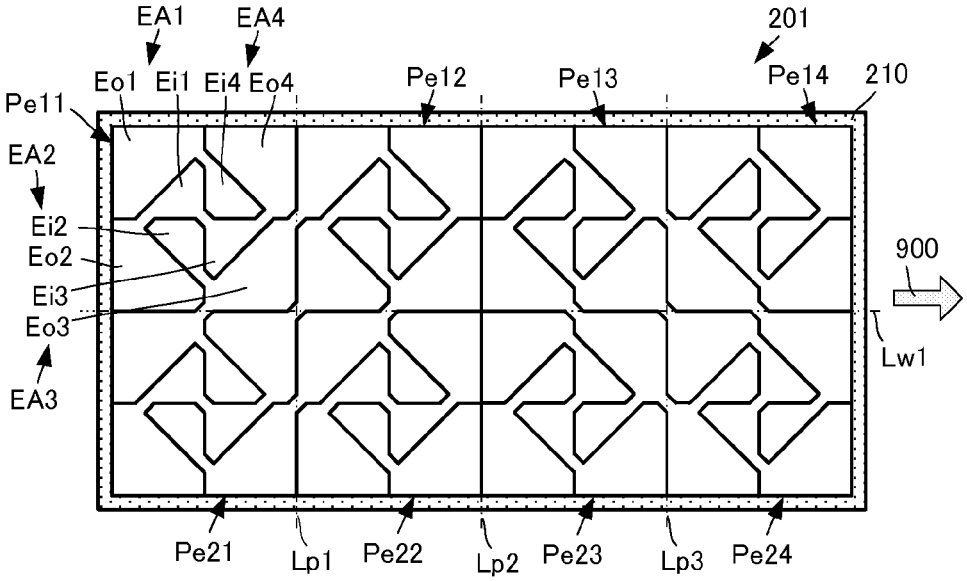
FIG. 4A is a plane view of a first piezoelectric speaker 201 viewed from an electrode pattern 211 side.
Figure 4B:
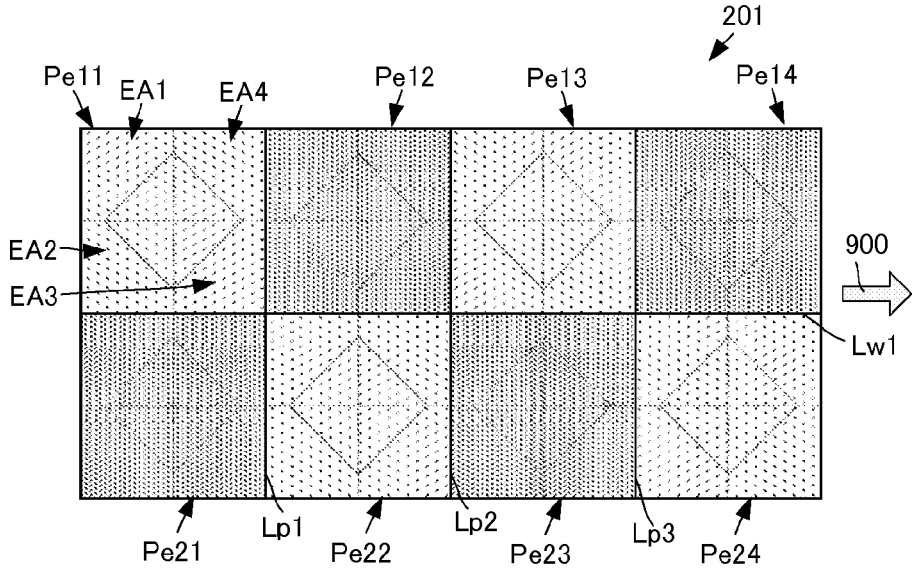
FIG. 4B is a plane view for illustrating a unit of an individual piezoelectric element.
Figure 5A:
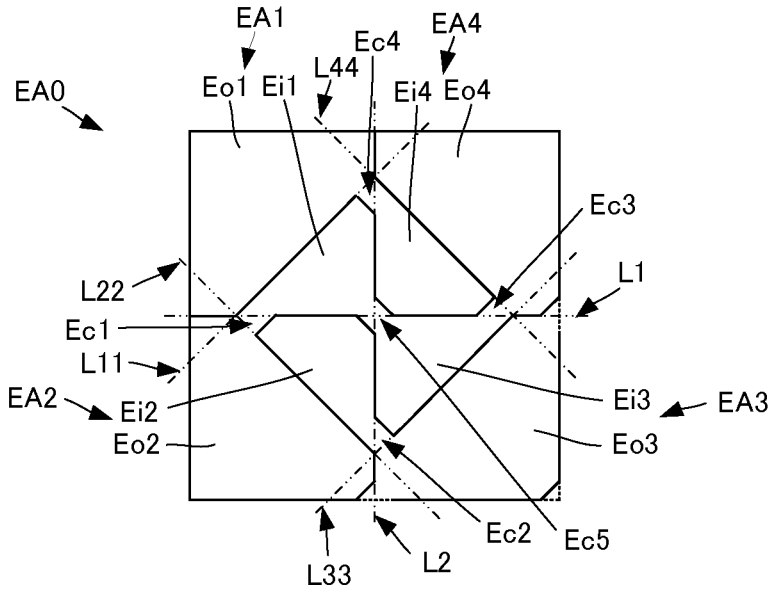
FIG. 5A is a view of an electrode pattern of a fundamental electrode pattern EA0 of the individual piezoelectric element.
Figure 5B:
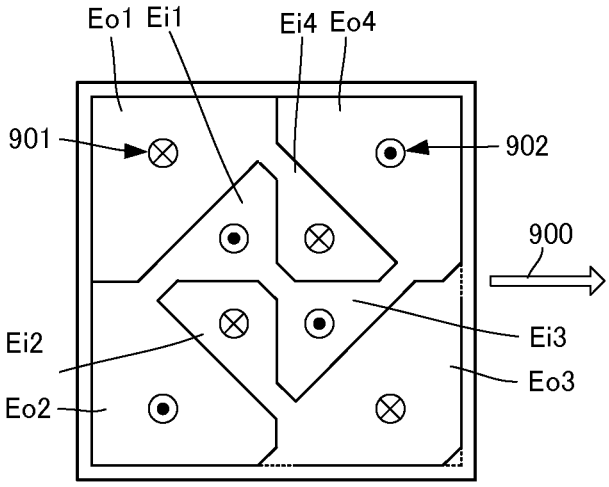
FIG. 5B is a view illustrating an example of an applied electric field pattern.

Next, the electrode pattern 211 and the electrode pattern 212 will be described. Since the electrode pattern 211 and the electrode pattern 212 have the same electrode pattern shape, the electrode pattern 211 only will be specifically described and the electrode pattern 212 will be described only when it is necessary. FIG. 4A is a plane view of the first piezoelectric speaker 210 viewed from the electrode pattern 211 side, and FIG. 4B is a plane view for illustrating a unit of the individual piezoelectric element. FIG. 5A is a view of an electrode pattern of a fundamental electrode pattern EA0 of the individual piezoelectric element, and FIG. 5B is a view illustrating an example of the applied electric field pattern. It is noted that the specific description of the connection pattern for connecting respective divided electrodes will be omitted except when it is necessary.

The electrode pattern 211 is formed such that plural fundamental electrode patterns EA0 are aligned. For example, in the example of the present embodiment, for one primary surface of the polymer sheet 210, a two-dimensional alignment in which four fundamental electrode patterns EA0 are aligned along the longitudinal direction (extending direction) of the primary surface of the polymer sheet 210 and two fundamental electrode patterns EA0 are aligned along the short direction of the primary surface. The electrode pattern 212 also has the fundamental electrode pattern aligned in 4×2 alignment pattern similarly to the electrode pattern 211.

Such electrode patterns 211 and 212 are formed on both primary surfaces of the polymer sheet 210 such that respective fundamental electrode patterns EA0 substantially face to each other. Thereby, individual piezoelectric elements Pe11 to Pe14 and Pe21 to Pe24 are formed, respectively, by respective opposing fundamental electrode patterns EA0 of the electrode patterns 211 and 212 and the sub-region of the polymer sheet 210 interposed between these fundamental electrode patterns EA0. As a result, as illustrated in FIGS. 4A and 4B, the two-dimensionally aligned (in the present embodiment, 4×2=8) individual piezoelectric elements Pe11 to Pe14 and Pe21 to Pe24 are arranged over the entire surface of the single polymer sheet 210.

In this case, each of the individual piezoelectric elements Pe11 to Pe14 and Pe21 to Pe24 is divided by the dividing line Lw1 that is parallel to the extending direction (the direction of the symbol 900) and the dividing lines Lp1, Lp2, and Lp3 that are orthogonal to the extending direction (the direction of the symbol 900). It is noted that, in the present invention, the dividing line refers to a groove (a part where no electrode is formed) that electrically and/or mechanically divides the electrodes into multiple regions rather than the one merely partitions the electrodes into multiple regions.

As illustrated in FIGS. 5A and 5B, the fundamental electrode pattern EA0 has a rectangle external shape in the plane view and is divided into four regions of a first region, a second region, a third region, and a fourth region by a dividing line L1 that is parallel to the extending direction (the direction of the symbol 900) and a dividing line L2 that is orthogonal to the extending direction. The dividing line L1 and the dividing line L2 are formed so as to intersect at substantially the center (the center of gravity) of the rectangle fundamental electrode pattern EA0. Although the fundamental electrode pattern EA0 here is depicted as substantially square, it may be rectangular. The shape of the fundamental electrode pattern EA0 may be arranged so as to be optimum taking into consideration of the aspect ratio of the external form of the piezoelectric speaker and the number of the fundamental electrode patterns.

The first region and the second region are located symmetrically interposing the dividing line L1, and the third region and the fourth region are also located symmetrically interposing the dividing line L1. The first region and the fourth region are located symmetrically interposing the dividing line L2, and the second region and the fourth region are also located symmetrically interposing the dividing line L2.

The first region includes an inner side electrode Ei1 and an outer side electrode Eo1 that are divided by the dividing line L11 intersecting to the dividing line L1 and the dividing line L2 at approximately 45 degrees. In this case, the part near the intersection of the dividing line L1 and the dividing line L2 is the inner side electrode Ei1 and its shape is triangle in the plane view. On the other hand, the part away from the intersection of the dividing line L1 and the dividing line L2 is the outer side electrode Eo1 and its shape is pentagonal in the plane view. In the present embodiment, they are formed such that the outer side electrode Eo1 is wider than the inner side electrode Ei1.

The second region includes an inner side electrode Ei2 and an outer side electrode Eo2 that are divided by the dividing line L22 that intersects the dividing line L1 and the dividing line L2 at approximately 45 degrees and is orthogonal to the dividing line L11. The part near the intersection of the dividing line L1 and the dividing line L2 is the inner side electrode Ei2 and the part away from the intersection of the dividing line L1 and the dividing line L2 is the outer side electrode Eo2.

The third region includes an inner side electrode Ei3 and an outer side electrode Eo3 that are divided by the dividing line L33 that intersects the dividing line L1 and the dividing line L2 at approximately 45 degrees and is parallel to the dividing line L11. The part near intersection of the dividing line L1 and the dividing line L2 is the inner side electrode Ei3 and the part away from the intersection of the dividing line L1 and the dividing line L2 is the outer side electrode Eo3.

The fourth region includes an inner side electrode Ei4 and an outer side electrode Eo4 that are divided by the dividing line L44 that intersects the dividing line L1 and the dividing line L2 at approximately 45 degrees and is parallel to the dividing line L22. The part near the intersection of the dividing line L1 and the dividing line L2 is the inner side electrode Ei4 and the part away from the intersection of the dividing line L1 and the dividing line L2 is the outer side electrode Eo4.

As such, the inner side electrodes Ei1, Ei2, Ei3, and Ei4 are formed so as to be 90° rotational symmetry with respect to the intersection of the dividing line L1 and the dividing line L2 as the rotational symmetry reference, and the outer side electrodes Eo1, Eo2, Eo3, and Eo4 are also formed so as to be 90° rotational symmetry with respect to the intersection of the dividing line L1 and the dividing line L2 as the rotational symmetry reference. It is noted that the respective area ratios of the triangular inner side electrodes Ei1, Ei2, Ei3, and Ei4 to the pentagonal outer side electrodes Eo1, Eo2, Eo3, and Eo4 are a design matter that should be designed to be optimum depending on the thickness of the sheet and the piezoelectricity constant.

In such arrangement, the electrode patterns 211 and 212 are arranged so that the above-described fundamental electrode patterns EA0 substantially face to each other, which means, in other words with more specific sense, the above-described inner side electrodes Ei1, Ei2, Ei3, and Ei4 and the outer side electrodes Eo1, Eo2, Eo3, and Eo4 of the fundamental electrode patterns EA0 of the electrode pattern 211 and the fundamental electrode patterns EA0 of the electrode pattern 212 are arranged so as to substantially correspond to each other when viewed from the direction orthogonal to the primary surface.

The electric field of the pattern illustrated in FIG. 5B is applied to the fundamental electrode patterns EA0 of the above arrangement. In FIG. 5B, the symbol 901 represents an electric field from the top to the backside of the drawing sheet, and the symbol 902 represents an electric field from the backside to the top of the drawing sheet.

Specifically, the voltage for generating the electric field illustrated by the symbol 901 is applied to the outer side electrodes Eo1 and Eo3 of the first region and the third region and the inner side electrodes Ei2 and Ei4 of the second region and the fourth region. At the same time, the voltage for generating the electric field illustrated by the symbol 902 is applied to the inner side electrodes Ei1 and Ei3 of the first region and the third region and the outer side electrodes Eo2 and Eo4 of the second region and the fourth region. This causes the opposite electric fields to be applied to the part of the inner side electrode and the part of the outer side electrode that divide each region, so that the electric field that is reversely symmetrical with respect to the dividing lines L1 and L2 is applied.

Figure 6:
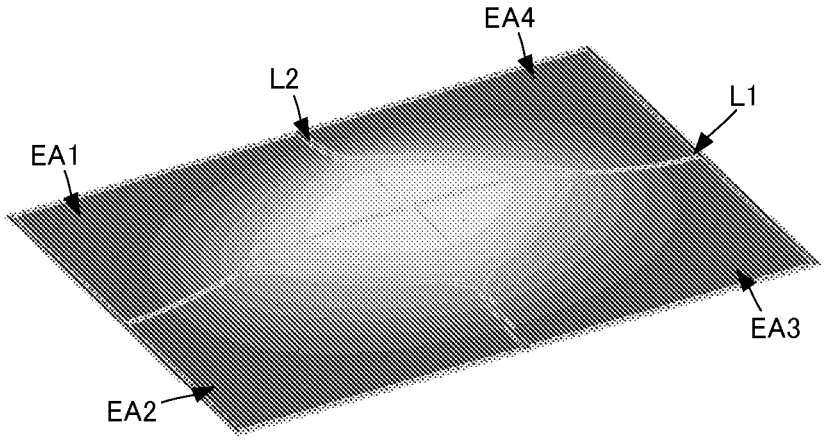
FIG. 6 is a view illustrating a deformation movement when an electric field is applied to an individual piezoelectric element Pe11 with a distribution as illustrated in FIG. 5B.

FIG. 6 is a view illustrating the deformation movement when an electric field is applied to the individual piezoelectric element Pe11 with a distribution as illustrated in FIG. 5B. FIG. 6 illustrates that the displacement is smaller as it approaches deep color (black) while the displacement is larger as it approaches light color (white). Further, although FIG. 6 illustrates a rectangular individual piezoelectric element, the similar movement will be observed in a square one.

As illustrated in FIG. 6, the application of the electric field of the pattern of FIG. 5B causes the individual piezoelectric element Pe11 to have the largest amount of displacement at the center of each region, that is, the intersection of the dividing line L1 and the dividing line L2, and the amount of the displacement gradually decreases toward the peripheral region.

The electric field of the pattern illustrated in FIG. 5B is applied at a timing and then the electric field opposite to the pattern illustrated in FIG. 5B is applied at another timing. Repetition of such changes in the application direction of the electric field causes the individual piezoelectric element Pe11 to vibrate along the direction orthogonal to the primary surface. This enables the individual piezoelectric element Pe11 to emit sound (sound emission).

It is noted that, as illustrated in FIG. 5A, the outer side electrode Eo1 of the first region and the inner side electrode Ei4 of the fourth region are connected by a connection electrode Ec4, the outer side electrode Eo2 of the second region and the inner side electrode Ei1 of the first region are connected by a connection electrode Ec1, the outer side electrode Eo3 of the third region and the inner side electrode Ei2 of the second region are connected by a connection electrode Ec2, the outer side electrode Eo4 of the fourth region and the inner side electrode Ei3 of the third region are connected by a connection electrode Ec3, and the inner side electrode Ei1 of the first region and the inner side electrode Ei3 of the third region are connected by a connection electrode Ec5. This arrangement allows for the omission of the connection electrode patterns that directly connect the external part to the inner side electrodes Ei1, Ei2, Ei3, and Ei4, while realizing a desired electric field application pattern, so that the structure can be simplified. In this case, the connection electrodes Ec1, Ec2, Ec3, Ec4, and Ec5 have shapes with extremely short width and length, which do not affect the vibration of the individual piezoelectric elements.

Figure 7:
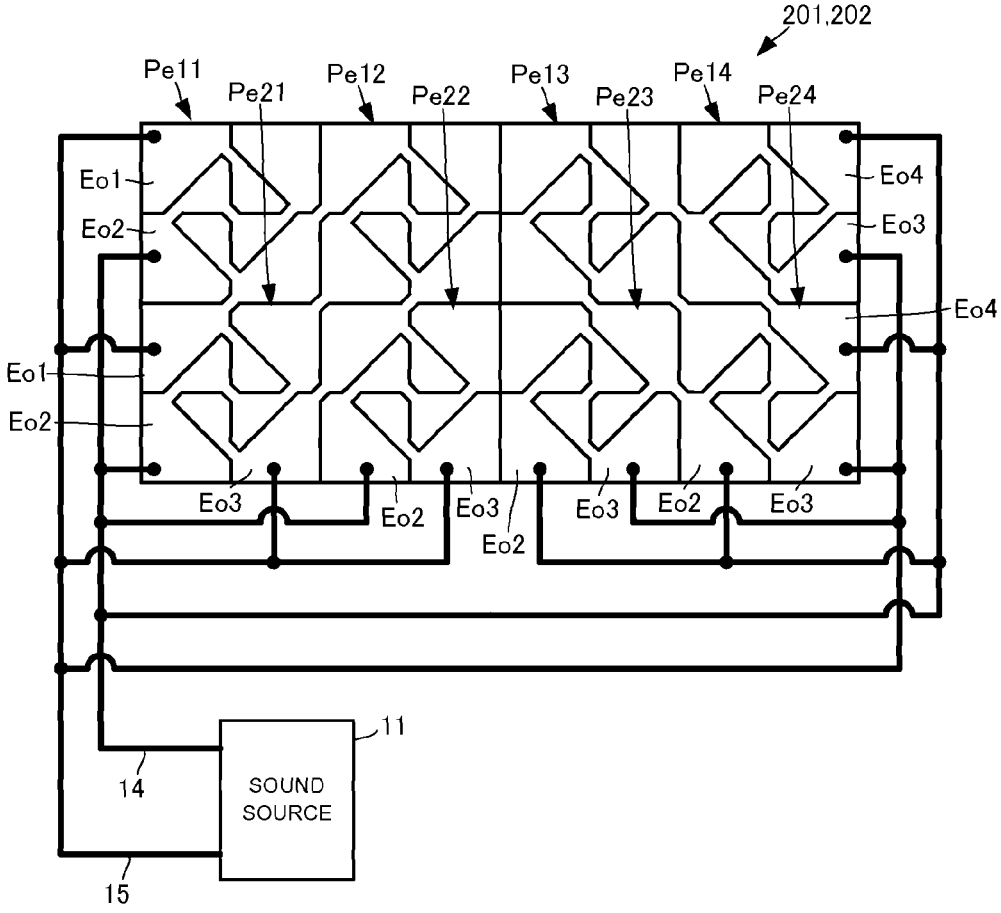
FIG. 7 is a view illustrating a supplying configuration of an acoustic signal to the piezoelectric speaker 10 according to the first embodiment.

An acoustic driving signal is applied to the above-structured individual piezoelectric elements Pe11 to Pe14 and Pe21 to Pe24 with the wiring pattern as illustrated in FIG. 7. FIG. 7 is a view illustrating the supplying configuration of an acoustic signal to the piezoelectric speaker 10 according to the present embodiment.

The outer side electrode Eo1 of the individual piezoelectric element Pe11, the outer side electrodes Eo1 and Eo3 of the individual piezoelectric element Pe21, the outer side electrode Eo3 of the individual piezoelectric element Pe22, and outer side electrodes Eo3 of the individual piezoelectric elements Pe23, Pe24, and Pe14 of the piezoelectric speaker 10 are connected to a sound source 11 via a connection wiring pattern 15.

The outer side electrodes Eo2 of the individual piezoelectric elements Pe11, Pe21, Pe22, and Pe23, the outer side electrodes Eo2 and Eo4 of the individual piezoelectric element Pe24, and the outer side electrode Eo4 of the individual piezoelectric element Pe14 are connected to the sound source 11 via a connection wiring pattern 14.

Although not depicted here, the outer side electrode Eo1 of the individual piezoelectric element Pe21 is connected to the outer side electrode Eo3 of the individual piezoelectric element Pe11, and the outer side electrode Eo3 of the individual piezoelectric element Pe11 is connected to the outer side electrode Eo1 of the individual piezoelectric element Pe12.

The outer side electrode Eo3 of the individual piezoelectric element Pe21 is connected to the outer side electrode Eo1 of the individual piezoelectric element Pe22, and the outer side electrode Eo1 of the individual piezoelectric element Pe22 is connected to the outer side electrode Eo3 of the individual piezoelectric element Pe12.

The outer side electrode Eo4 of the individual piezoelectric element Pe21 is connected to the outer side electrode Eo2 of the individual piezoelectric element Pe12.

The outer side electrode Eo2 of the individual piezoelectric element Pe24 is connected to the outer side electrode Eo4 of the individual piezoelectric element Pe23, and the outer side electrode Eo3 of the individual piezoelectric element Pe23 is connected to the outer side electrode Eo2 of the individual piezoelectric element Pe13.

The outer side electrode Eo4 of the individual piezoelectric element Pe24 is connected to the outer side electrode Eo2 of the individual piezoelectric element Pe14, and the outer side electrode Eo2 of the individual piezoelectric element Pe14 is connected to the outer side electrode Eo4 of the individual piezoelectric element Pe13.

The sound source 11 generates, from a single acoustic signal, a first acoustic driving signal and a second acoustic driving signal whose amplitudes are always inverse to each other. The sound source 11 supplies the first acoustic driving signal to each electrode connected to the connection wiring pattern 14 via the connection wiring pattern 14. The sound source 11 supplies the second acoustic driving signal to each electrode connected to the connection wiring pattern 15 via the connection wiring pattern 15.

Figure 8A:
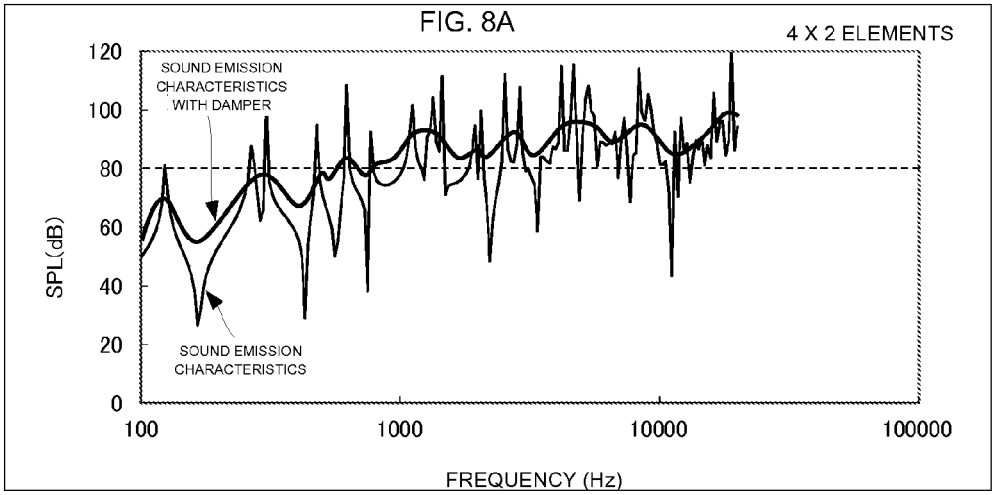
FIG. 8A represents a view illustrating a sound pressure level to frequency characteristics according to the first embodiment.
Figure 8B:
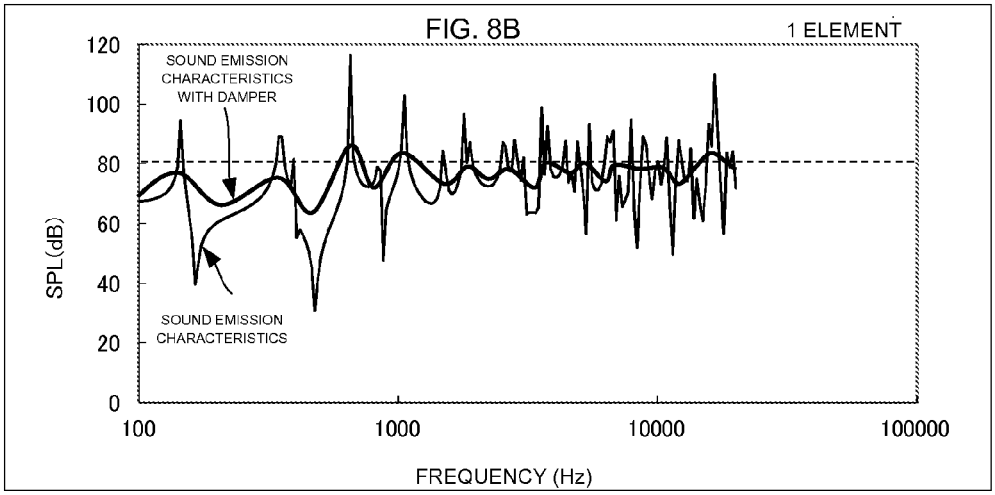
FIG. 8B represents a view illustrating a sound pressure level to frequency characteristics when a single individual piezoelectric element is formed using an entire surface of a polymer sheet having the same area as that in the arrangement of the first embodiment.
Figure 8B:
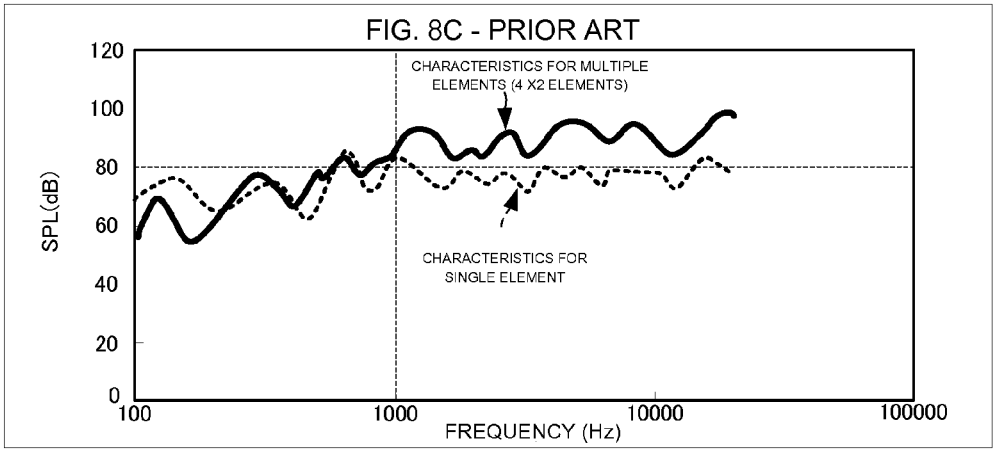

Such application control of the acoustic driving signals causes respective individual piezoelectric elements Pe11 to Pe14 and Pe21 to Pe24 to operate in substantially a synchronized manner to emit sound toward the front direction of the piezoelectric speaker 10. FIG. 8A is a view illustrating the sound pressure level to frequency characteristics according to the present embodiment, and FIG. 8B illustrates the sound pressure level to frequency characteristics when a single individual piezoelectric element is formed using the entire surface of the polymer sheet having the same area as that in the arrangement of the present embodiment. FIG. 8C is a view comparing the sound pressure level to frequency characteristics in the arrangement of the present embodiment with that in the single individual piezoelectric element. It is noted that FIGS. 8A to 8C are simulation results by the finite element method in the case of the bimorph shape where the thickness of the base member 100 is 0.075 mm, the external shape in forming the electrode pattern on the polymer sheet is 160 mm in the extending direction and 90 mm in the direction orthogonal to the extending direction, and the thickness of the polymer sheet is 0.05 mm, and in the case where the driving voltage is 288 Vp-p and the measuring point of the sound pressure is the position at 1 mm distant in the front direction from the piezoelectric speaker 10. Further, in FIGS. 8A to 8C, the thin line represents the characteristics when no protection sheet is provided and the thick line represents the characteristics when a protection sheet is attached.

As illustrated in FIGS. 8A to 8C, the use of the arrangement of the present embodiment allows for the improved sound pressure level compared to the case where the single individual piezoelectric element having the same area is formed. In particular, the sound pressure level at equal to or above 1000 Hz where human sound detection sensitivity is high can be improved. Further, the resonance peak is increased in the arrangement of the present embodiment, so that the characteristics after the buffering by the protection film are flatter compared to the case where the single individual piezoelectric element having the same area is formed.

As described above, the use of the arrangement where the plural individual piezoelectric elements are formed on the polymer sheet as illustrated in the present embodiment allows for a piezoelectric speaker with a high sound pressure under the specified area. Further, a piezoelectric speaker that is superior in the sound level-frequency characteristics can be configured.

Figure 9:
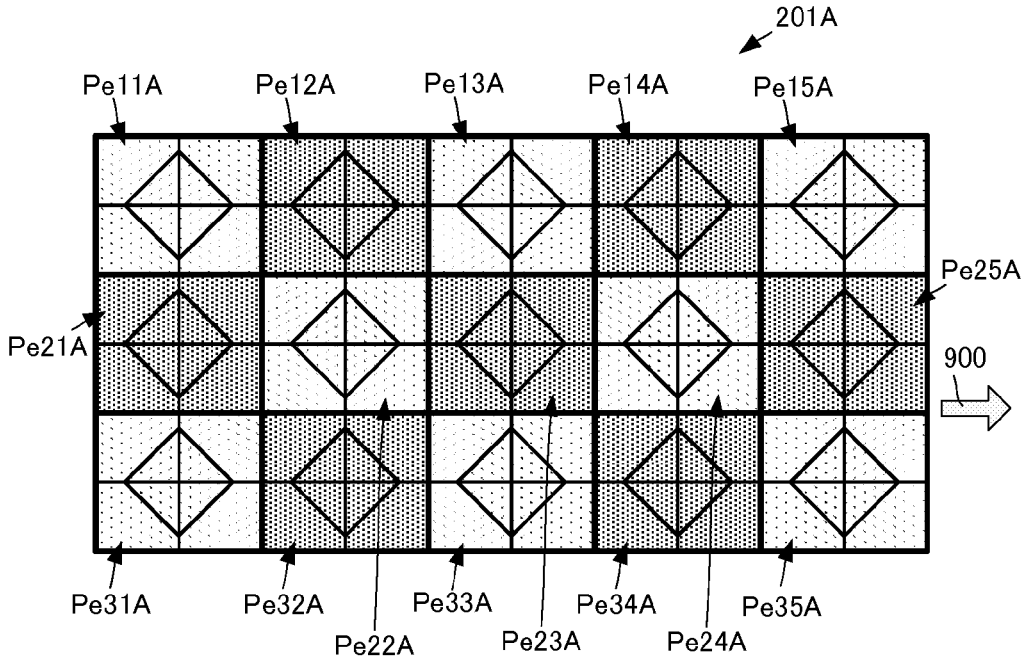
FIG. 9 is a plane view depicting, in a simplified manner, an electrode pattern of a piezoelectric speaker according to a second embodiment.

Next, the piezoelectric speaker according to the second embodiment will be described by referring to the drawings. FIG. 9 is a plane view depicting, in a simplified manner, an electrode pattern of the piezoelectric speaker according to the second embodiment. It is noted that the hatching in the drawing is made for easier identification of each individual piezoelectric element and it is the same as the first embodiment that the whole of it has a predetermined transmittance.

Although a first piezoelectric speaker 201A in the bimorph-shaped piezoelectric speaker only will be described below, a second piezoelectric speaker opposing to the first piezoelectric speaker 201A interposing the base member 100 has the same structure as the first piezoelectric speaker 201A.

The first piezoelectric speaker 201A of the present embodiment is arranged with 5×3=15 individual piezoelectric elements, while the first piezoelectric speaker 201 illustrated in the first embodiment is arranged with 4×2=8 individual piezoelectric elements. That is, while external shapes of the electrode pattern to the polymer sheet are the same, the shape of each of the individual piezoelectric elements Pe11A to Pe15A, Pe21A to Pe25A, and Pe31A to Pe35A is smaller than the individual piezoelectric elements Pe11 to Pe14 and Pe21 to Pe24 of the first embodiment and therefore the number of individual piezoelectric elements is increased.

Figure 10:
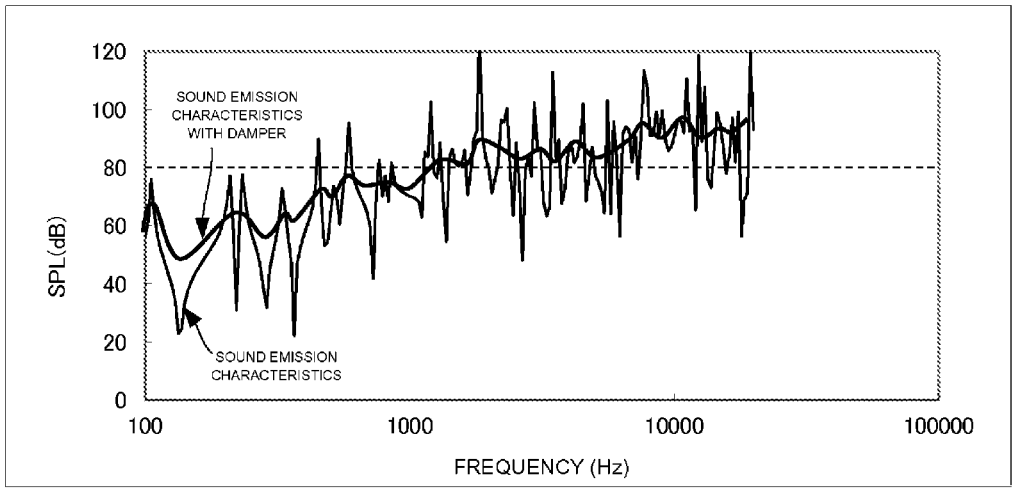
FIG. 10 is a view illustrating a sound pressure level to frequency characteristics of the piezoelectric speaker according to the second embodiment.

FIG. 10 is a view illustrating the sound pressure level to frequency characteristics of the piezoelectric speaker according to the present embodiment. As illustrated in FIG. 10, further increased the number of aligned individual piezoelectric elements allows resonance peaks to be increased, so that the flatness of the frequency characteristics can be improved. Further, along with the buffer effect by the protection sheet, the frequency characteristics can be further improved.

Figure 11A:
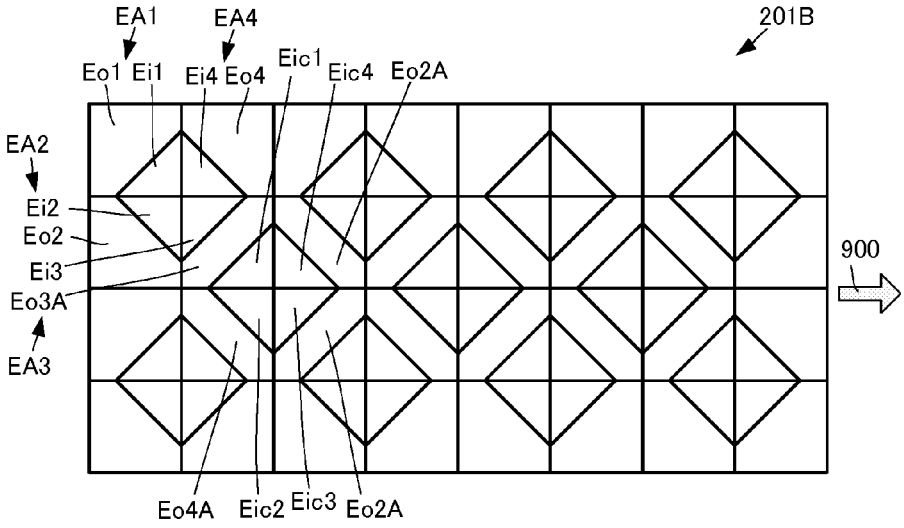
FIG. 11A represents a plane view of a first piezoelectric speaker 201B of a piezoelectric speaker according to a third embodiment viewed from an electrode pattern 211B side.
Figure 11B:
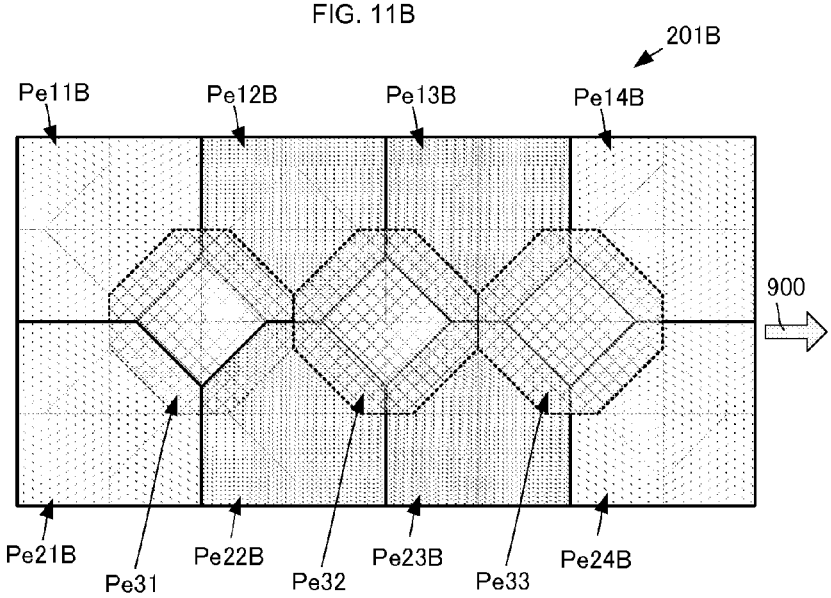
FIG. 11B represents a plane view for illustrating a unit of an individual piezoelectric element in the same embodiment.

Next, the piezoelectric speaker according to the third embodiment will be described by referring to the drawings. FIG. 11A is a plane view of a first piezoelectric speaker 201B of the piezoelectric speaker according to the third embodiment viewed from an electrode pattern 211B side and FIG. 11B is a plane view for illustrating a unit of an individual piezoelectric element in the present embodiment. It is noted that the hatching in the drawing is made for easier identification of each individual piezoelectric element and it is the same as the first and second embodiments that the whole of it has a predetermined transmittance.

Although a first piezoelectric speaker 201B in the bimorph-shaped piezoelectric speaker only will be described below, a second piezoelectric speaker opposing to the first piezoelectric speaker 201B interposing the base member 100 has the same structure as the first piezoelectric speaker 201B.

In the first piezoelectric speaker 201B of the present embodiment, further added individual piezoelectric elements are formed at the center of the region in which neighboring 2×2 individual piezoelectric elements are formed for the piezoelectric speaker 201 illustrated in the first embodiment.

Specifically, an individual piezoelectric element Pe31 is formed which has a new center at the center position of the outer side electrode Eo3 of the individual piezoelectric element Pe11B, the outer side electrode Eo4 of the individual piezoelectric element Pe21B, the outer side electrode Eo1 of the individual piezoelectric element Pe22B, and the outer side electrode Eo2 of the individual piezoelectric element Pe12B.

In this case, in the outer side electrode Eo3 of the individual piezoelectric element Pe11B, the region opposite to the inner side electrode Ei3 is divided by a dividing line to form the inner side electrode Eic1 of the individual piezoelectric element Pe31B. In the outer side electrode Eo4 of the individual piezoelectric element Pe21B, the region opposite to the inner side electrode Ei4 is divided by a dividing line to form the inner side electrode Eic2 of the individual piezoelectric element Pe31. In the outer side electrode Eo1 of the individual piezoelectric element Pe22B, the region opposite to the inner side electrode Ei1 is divided by a dividing line to form the inner side electrode Eic3 of the individual piezoelectric element Pe31. In the outer side electrode Eo2 of the individual piezoelectric element Pe12B, the region opposite to the inner side electrode Ei2 is divided by a dividing line to form the inner side electrode Eic4 of the individual piezoelectric element Pe31.

Similarly, an individual piezoelectric element Pe32 is formed which has a new center at the center position of the outer side electrode Eo3 of the individual piezoelectric element Pe12B, the outer side electrode Eo4 of the individual piezoelectric element Pe22B, the outer side electrode Eo1 of the individual piezoelectric element Pe23B, and the outer side electrode Eo2 of the individual piezoelectric element Pe13B.

An individual piezoelectric element Pe33 is formed which has a new center at the center position of the outer side electrode Eo3 of the individual piezoelectric element Pe13B, the outer side electrode Eo4 of the individual piezoelectric element Pe23B, the outer side electrode Eo1 of the individual piezoelectric element Pe24B, and the outer side electrode Eo2 of the individual piezoelectric element Pe14B.

Such arrangement allows the number of individual piezoelectric elements to be increased to 11, while the area of the inner side electrode is maintained under the same external shape area of the electrode forming region as the piezoelectric speaker of the first embodiment.

Figure 12:
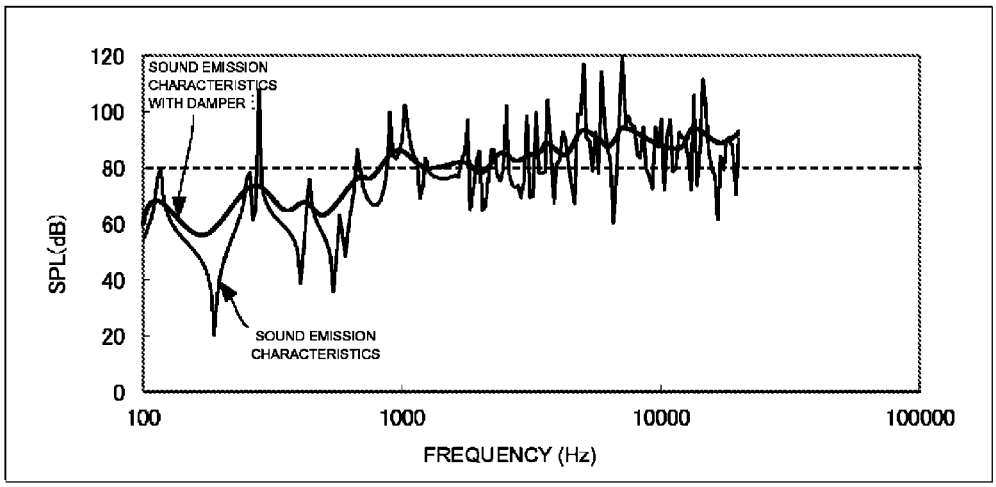
FIG. 12 is a view illustrating a sound pressure level to frequency characteristics of the piezoelectric speaker according to the third embodiment.

FIG. 12 is a view illustrating the sound pressure level to frequency characteristics of the piezoelectric speaker according to the present embodiment. The use of the arrangement of the present embodiment allows for the increased resonance peak, in particular, in the upper sound range equal to or above 1000 Hz as illustrated in FIG. 12, so that the flatness of the sound pressure level to frequency characteristics in this sound range can be improved.

Figure 13:
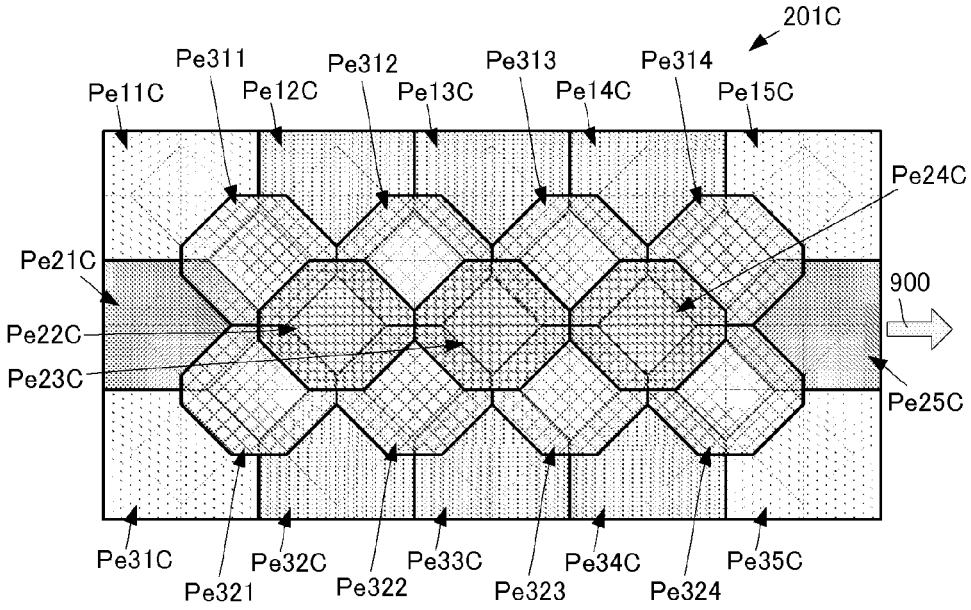
FIG. 13 is a plane view depicting, in a simplified manner, an electrode pattern of a piezoelectric speaker according to a fourth embodiment.

Next, the piezoelectric speaker according to the fourth embodiment will be described by referring to the drawings. FIG. 13 is a plane view depicting, in a simplified manner, an electrode pattern of the piezoelectric speaker according to the fourth embodiment. It is noted that the hatching in the drawing is made for easier identification of each individual piezoelectric element and it is the same as the above-described embodiments that the whole of it has a predetermined transmittance.

Although a first piezoelectric speaker 201C in the bimorph-shaped piezoelectric speaker only will be described below, a second piezoelectric speaker opposing to the first piezoelectric speaker 201C interposing the base member 100 has the same structure as the first piezoelectric speaker 201C.

The piezoelectric speaker of the present embodiment is made by applying the arrangement of the third embodiment to the piezoelectric speaker formed with 5×3=15 individual piezoelectric elements of the second embodiment described above.

Specifically, an individual piezoelectric element Pe311 is formed which has a new center at the center position of the outer side electrode Eo3 of the individual piezoelectric element Pe11C, the outer side electrode Eo4 of the individual piezoelectric element Pe21C, the outer side electrode Eo1 of the individual piezoelectric element Pe22C, and the outer side electrode Eo2 of the individual piezoelectric element Pe12C.

An individual piezoelectric element Pe312 is formed which has a new center at the center position of the outer side electrode Eo3 of the individual piezoelectric element Pe12C, the outer side electrode Eo4 of the individual piezoelectric element Pe22C, the outer side electrode Eo1 of the individual piezoelectric element Pe23C, and the outer side electrode Eo2 of the individual piezoelectric element Pe13C.

An individual piezoelectric element Pe313 is formed which has a new center at the center position of the outer side electrode Eo3 of the individual piezoelectric element Pe13C, the outer side electrode Eo4 of the individual piezoelectric element Pe23C, the outer side electrode Eo1 of the individual piezoelectric element Pe24C, and the outer side electrode Eo2 of the individual piezoelectric element Pe14C.

An individual piezoelectric element Pe314 is formed which has a new center at the center position of the outer side electrode Eo3 of the individual piezoelectric element Pe14C, the outer side electrode Eo4 of the individual piezoelectric element Pe24C, the outer side electrode Eo1 of the individual piezoelectric element Pe25C, and the outer side electrode Eo2 of the individual piezoelectric element Pe15C.

An individual piezoelectric element Pe321 is formed which has a new center at the center position of the outer side electrode Eo3 of the individual piezoelectric element Pe21C, the outer side electrode Eo4 of the individual piezoelectric element Pe31C, the outer side electrode Eo1 of the individual piezoelectric element Pe32C, and the outer side electrode Eo2 of the individual piezoelectric element Pe22C.

An individual piezoelectric element Pe322 is formed which has a new center at the center position of the outer side electrode Eo3 of the individual piezoelectric element Pe22C, the outer side electrode Eo4 of the individual piezoelectric element Pe32C, the outer side electrode Eo1 of the individual piezoelectric element Pe33C, and the outer side electrode Eo2 of the individual piezoelectric element Pe23C.

An individual piezoelectric element Pe323 is formed which has a new center at the center position of the outer side electrode Eo3 of the individual piezoelectric element Pe23C, the outer side electrode Eo4 of the individual piezoelectric element Pe33C, the outer side electrode Eo1 of the individual piezoelectric element Pe34C, and the outer side electrode Eo2 of the individual piezoelectric element Pe24C.

An individual piezoelectric element Pe324 is formed which has a new center at the center position of the outer side electrode Eo3 of the individual piezoelectric element Pe24C, the outer side electrode Eo4 of the individual piezoelectric element Pe34C, the outer side electrode Eo1 of the individual piezoelectric element Pe35C, and the outer side electrode Eo2 of the individual piezoelectric element Pe25C.

Such arrangement allows the number of individual piezoelectric elements to be increased to 23, while the area of the inner side electrode is maintained under the same external shape area of the electrode forming region as the piezoelectric speaker of the third embodiment.

Figure 14:
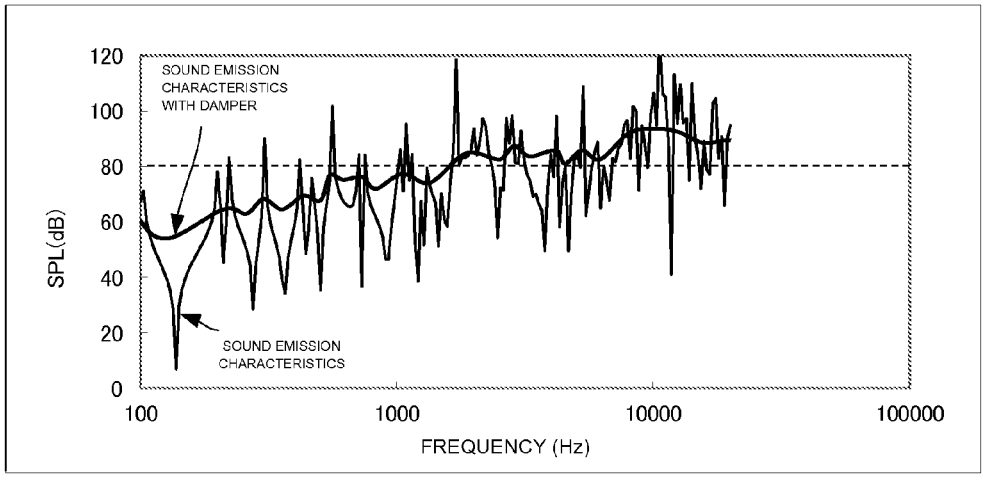
FIG. 14 is a view illustrating a sound pressure level to frequency characteristics of the piezoelectric speaker according to the fourth embodiment.

FIG. 14 is a view illustrating the sound pressure level to frequency characteristics of the piezoelectric speaker according to the present embodiment. The use of the arrangement of the present embodiment allows for the improved flatness of the sound pressure level to frequency characteristics, in particular, in the lower sound range equal to or under 1000 Hz.

Figure 15A:
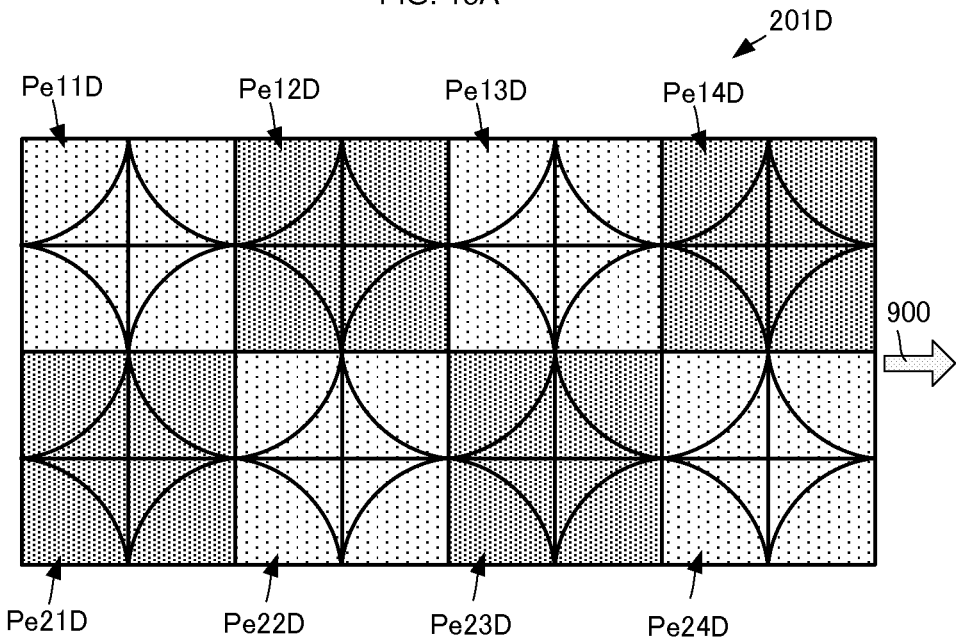
FIG. 15A is a plane view depicting, in a simplified manner, an electrode pattern of a piezoelectric speaker according to a fifth embodiment
Figure 15B:
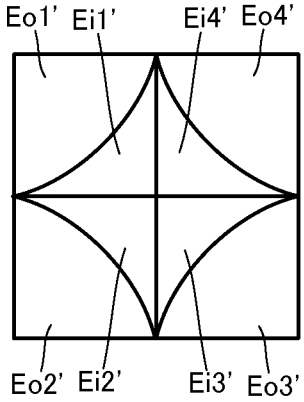
FIG. 15B is a view for illustrating an electrode pattern of an individual piezoelectric element of the piezoelectric speaker in the same embodiment.

Next, the piezoelectric speaker according to the fifth embodiment will be described by referring to the drawings. FIG. 15A is a plane view depicting, in a simplified manner, an electrode pattern of the piezoelectric speaker according to the fifth embodiment and FIG. 15B is a view for illustrating the electrode pattern of an individual piezoelectric element of the piezoelectric speaker in the present embodiment. It is noted that the hatching in FIG. 15A is made for easier identification of each individual piezoelectric element and it is the same as the above-described embodiments that the whole of it has a predetermined transmittance.

Although a first piezoelectric speaker 201D in the bimorph-shaped piezoelectric speaker only will be described below, a second piezoelectric speaker opposing to the first piezoelectric speaker 201D interposing the base member 100 has the same structure as the first piezoelectric speaker 201D.

In the piezoelectric speaker of the present embodiment, the dividing line for dividing into the inner side electrode and the outer side electrode in each region is formed by an asteroid curve in the piezoelectric speaker illustrated in the first embodiment, and other arrangements are the same. In this case, the asteroid curves are set so as to be convex toward the center of the individual piezoelectric elements Pe11D to Pe14D and Pe21D to Pe24D when viewed from the primary surface.

Figure 16:
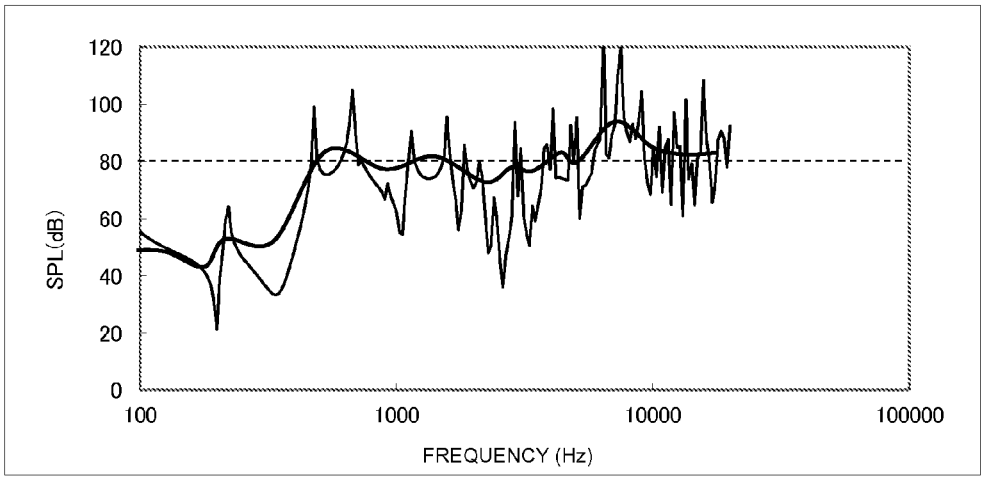
FIG. 16 is a view illustrating a sound pressure level to frequency characteristics of the piezoelectric speaker according to the fifth embodiment.

FIG. 16 is a view illustrating the sound pressure level to frequency characteristics of the piezoelectric speaker according to the present embodiment. The use of the arrangement of the present embodiment results in that the frequency characteristics are significantly changed as illustrated in FIG. 16, compared to the case where the above-described linear dividing lines are used. In particular, the sound level in the sound range from 500 Hz to 1000 Hz is improved, so that the sound pressure level to the frequency characteristics in this band can be improved. As such, the change in the dividing shape between the inner side electrode and the outer side electrode within an individual piezoelectric element can change the sound pressure level to the frequency characteristics even in the case of the piezoelectric speaker with the same external shape.

Figure 17A:
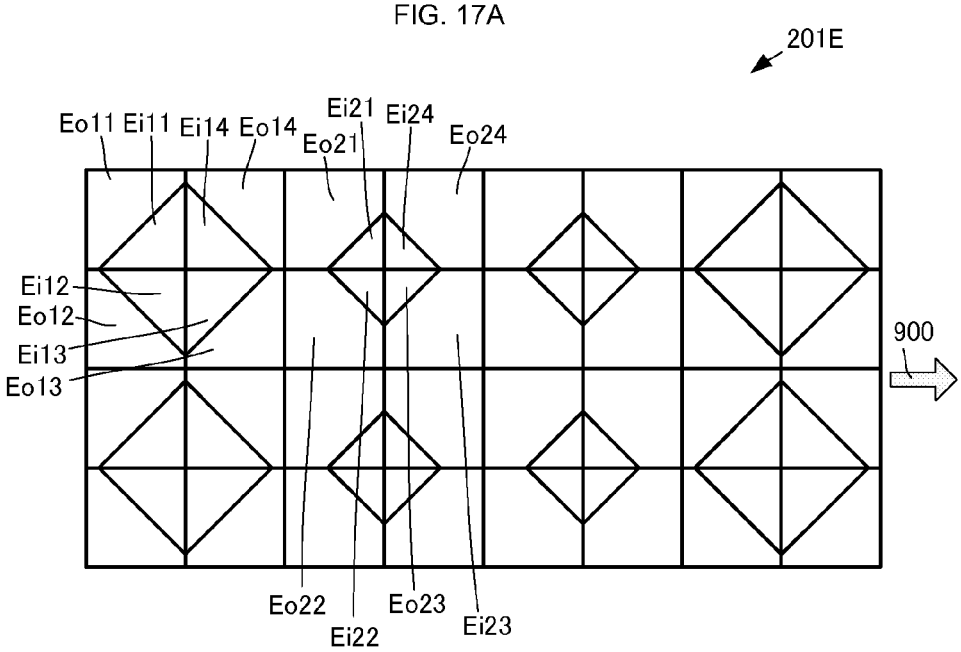
FIG. 17A is a plane view of a first piezoelectric speaker 201E of a piezoelectric speaker according to a sixth embodiment viewed from an electrode pattern 211B side and FIG. 17B is a plane view for illustrating a unit of an individual piezoelectric element in the same embodiment.
Figure 17B:
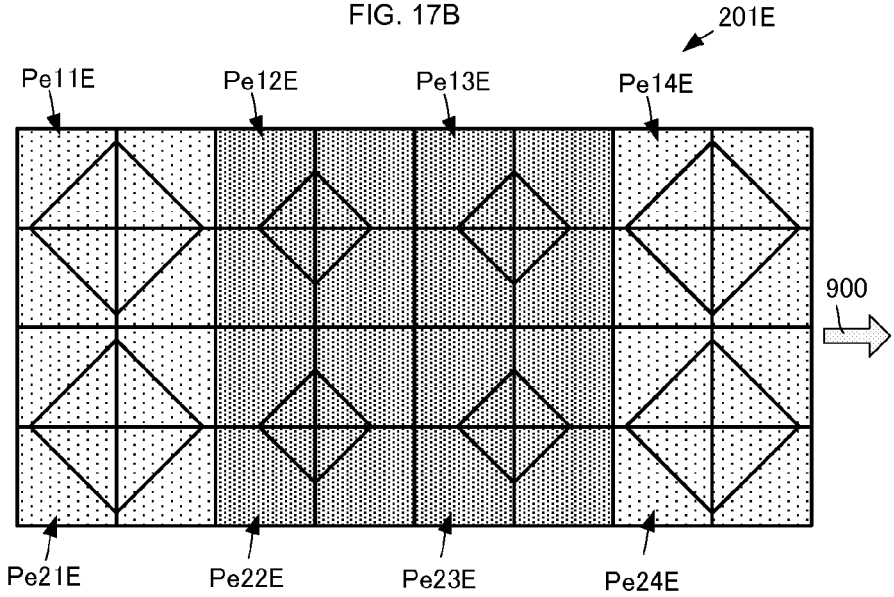

Next, the piezoelectric speaker according to the sixth embodiment will be described by referring to the drawings. FIG. 17A is a plane view of a first piezoelectric speaker 201E of the piezoelectric speaker according to the sixth embodiment viewed from an electrode pattern 211B side, and FIG. 17B is a plane view for illustrating a unit of an individual piezoelectric element in the present embodiment.

In the piezoelectric speaker of the present embodiment, while the number of aligned individual piezoelectric elements is the same as that in the piezoelectric speaker of the first embodiment, the individual piezoelectric elements of multiple types of the electrode patterns are combined. Specifically, the individual piezoelectric elements Pe11E, Pe21E, Pe14E, and Pe24E arranged at both ends in the extending direction have a first shape, and the individual piezoelectric elements Pe12E, Pe22E, Pe13E, and Pe23E have a second shape that is different from the first shape. The individual piezoelectric elements Pe11E, Pe21E, Pe14E, and Pe24E and the individual piezoelectric elements Pe12E, Pe22E, Pe13E, and Pe23E are different in the area ratio of the inner side electrode to the outer side electrode.

That is, the electrode pattern is formed so that the area ratio S(Ei21)/S(Eo21) of the inner side electrode Ei21 to the outer side electrode Eo21 of the individual piezoelectric elements Pe12E, Pe22E, Pe13E, and Pe23E is smaller than the area ratio S(Ei11)/S(Eo11) of the inner side electrode Ei11 to the outer side electrode Eo11 of the individual piezoelectric elements Pe12E, Pe22E, Pe13E, and Pe23E.

Figure 18A:
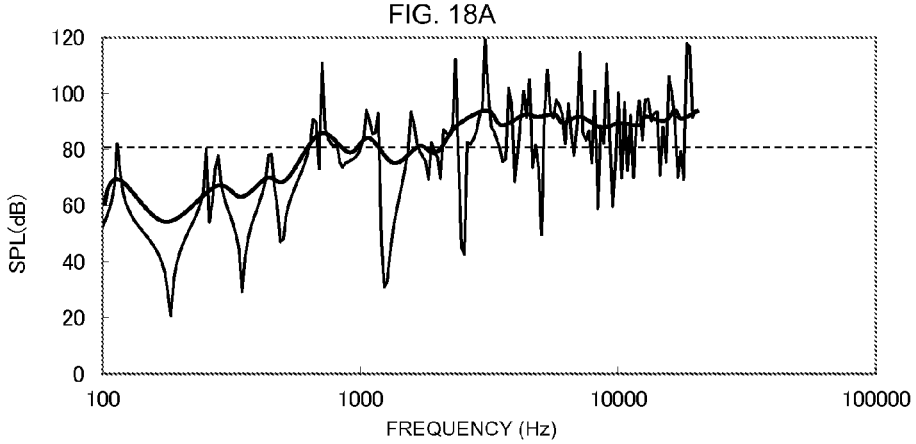
FIG. 18A is a view illustrating a sound pressure level to frequency characteristics of a piezoelectric speaker according to the sixth embodiment.
Figure 18B:
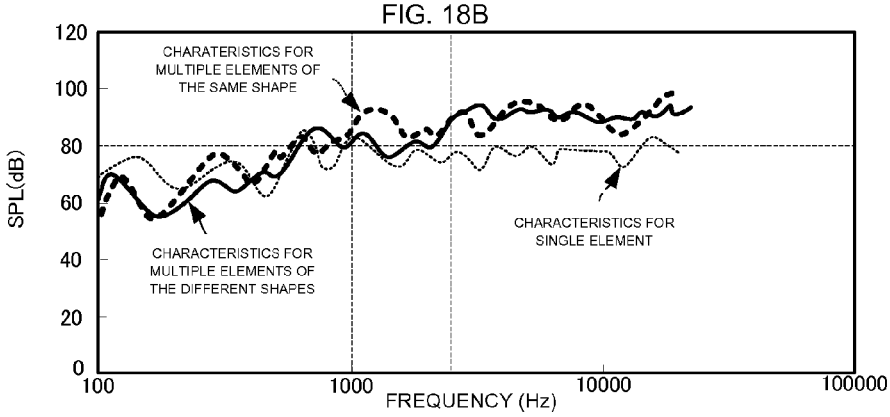
FIG. 18B is a view comparing the sound pressure level to frequency characteristics in the same embodiment, that in the first embodiment, and that in the case of a single individual piezoelectric element.

FIG. 18A is a view illustrating the sound pressure level to frequency characteristics of the piezoelectric speaker according to the present embodiment, and FIG. 18B is a view comparing the sound pressure level to frequency characteristics in the present embodiment, that in the first embodiment, and that in the case of a single individual piezoelectric element. The use of the arrangement of the present embodiment allows for the further improved flatness of the frequency characteristics in the upper sound range.

Figure 19:
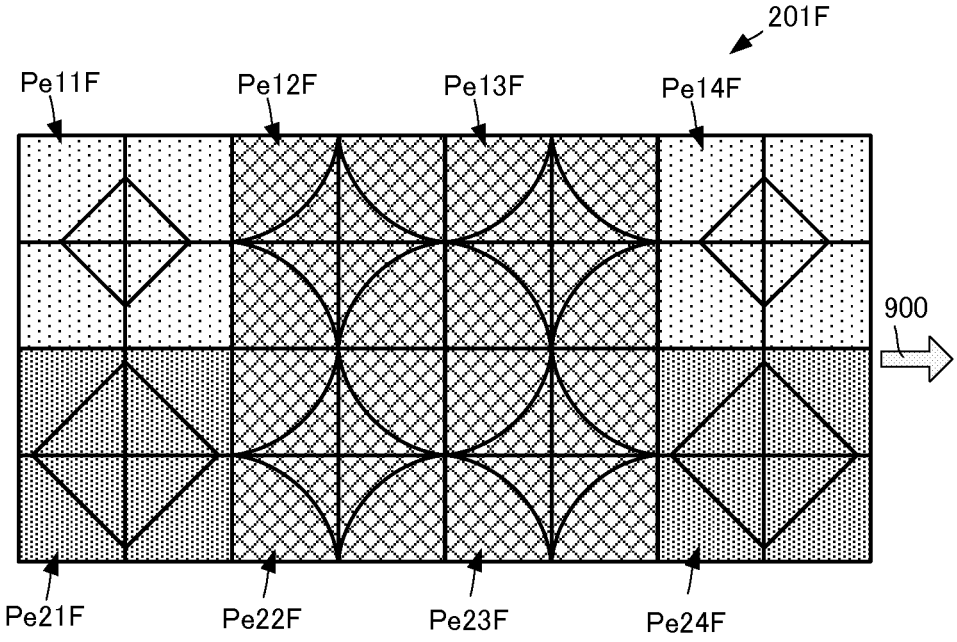
FIG. 19 is a plane view depicting, in a simplified manner, an electrode pattern of a piezoelectric speaker according to a seventh embodiment.

Next, the piezoelectric speaker according to the seventh embodiment will be described by referring to the drawings. FIG. 19 is a plane view depicting, in a simplified manner, an electrode pattern of the piezoelectric speaker according to the seventh embodiment. It is noted that the hatching in the drawing is made for easier identification of each individual piezoelectric element and it is the same as the above-described embodiments that the whole of it has a predetermined transmittance.

Although a first piezoelectric speaker 201F in the bimorph-shaped piezoelectric speaker only will be described below, a second piezoelectric speaker opposing to the first piezoelectric speaker 201F interposing the base member 100 has the same structure as the first piezoelectric speaker 201F.

As illustrated in FIG. 19, in the piezoelectric speaker of the present embodiment, the combination of the individual piezoelectric elements having different area ratios as described above is combined with the individual piezoelectric element formed by the dividing lines of the asteroid curves.

Specifically, the individual piezoelectric elements located at both ends in the extending direction have the linear dividing lines within the elements and include a set of individual piezoelectric elements Pe11F and Pe21F and a set of individual piezoelectric elements Pe14F and Pe24F that have the different area ratio of the inner side electrode to the outer side electrode. Further, four individual piezoelectric elements Pe12, Pe21, Pe13, and Pe23 located at the center in the extending direction are formed with the asteroid curve dividing line within the elements.

Such combination also allows for the desired sound pressure level to frequency characteristics according to the combination as described above.

It is noted that the combination of the individual piezoelectric elements illustrated in each embodiment as described above is an example and, as long as a single acoustic signal is supplied in a synchronized manner to plural individual piezoelectric elements, the effect and advantage of the present invention can be obtained, which allows for the flat type transparent speaker with the desired sound pressure level to frequency characteristics.

Figure 20:
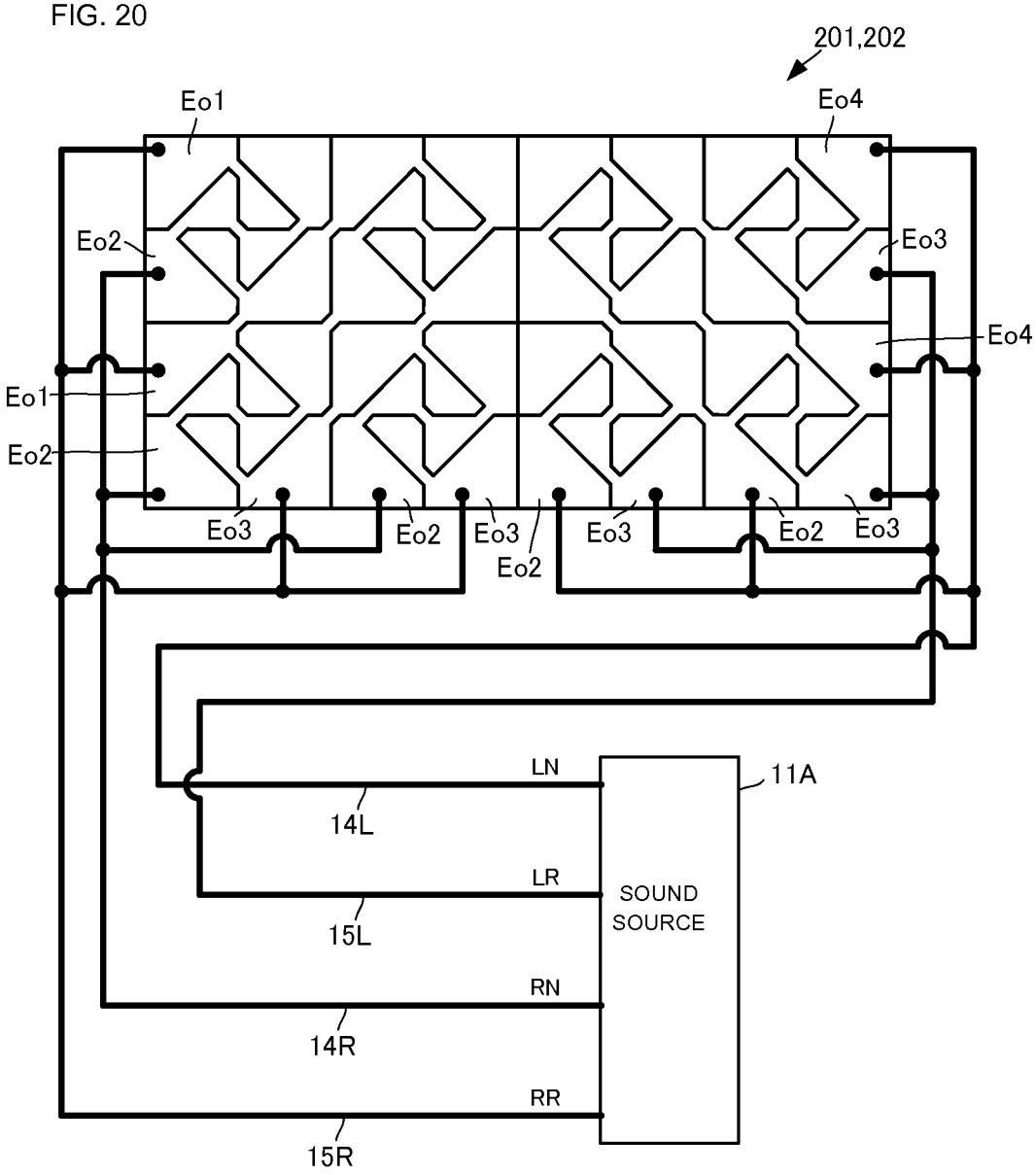
FIG. 20 is a view illustrating a supplying configuration of an acoustic signal to a piezoelectric speaker according to an eighth embodiment.

Next, the piezoelectric speaker according to the eighth embodiment will be described by referring to the drawings. FIG. 20 is a view illustrating the supplying configuration of an acoustic signal to the piezoelectric speaker according to the eighth embodiment.

While the case where a single channel acoustic signal is supplied to the entire piezoelectric speaker in each of the embodiments as described above, the case where a stereo acoustic signal is supplied is shown in the present embodiment.

It is noted that, since the arrangement of the piezoelectric speaker is the same as that in the first embodiment, the arrangement of the supplying system of the acoustic signal only will be described.

The outer side electrode Eo1 of the individual piezoelectric element Pe11, the outer side electrodes Eo1 and Eo3 of the individual piezoelectric element Pe21, and the outer side electrode Eo3 of the individual piezoelectric element Pe22 of the piezoelectric speaker are connected to a sound source 11A via a connection wiring pattern 15R. The outer side electrodes Eo3 of the individual piezoelectric elements Pe23, Pe24, and Pe14 of the piezoelectric speaker are connected to the sound source 11A via a connection wiring pattern 15L.

The outer side electrodes Eo2 of the individual piezoelectric elements Pe11, Pe21, and Pe22 of the piezoelectric speaker 10 are connected to the sound source 11A via a connection wiring pattern 14R. The outer side electrode Eo2 of the individual piezoelectric element Pe23, the outer side electrodes Eo2 and Eo4 of the individual piezoelectric element Pe24, and the outer side electrode Eo4 of the individual piezoelectric element Pe14 of the piezoelectric speaker 10 are connected to the sound source 11A via a connection wiring pattern 14L.

The sound source 11A generates, from an R channel acoustic signal constructing the stereo acoustic signal, a first Rch acoustic driving signal RN and a second Rch acoustic driving signal RR that are always inversed in amplitude. The sound source 11 generates, from an L channel acoustic signal constructing the stereo acoustic signal, a first Lch acoustic driving signal LN and a second Lch acoustic driving signal LR that are always inversed in amplitude.

The sound source 11A supplies the first Rch acoustic driving signal RN to each electrode connected to the connection wiring pattern 14R via the connection wiring pattern 14R. The sound source 11 supplies the second Rch acoustic driving signal RR to each electrode connected to the connection wiring pattern 15R via the connection wiring pattern 15R.

The sound source 11A supplies the first Lch acoustic driving signal LN via the connection wiring pattern 14L to each electrode connected to the connection wiring pattern 14L. The sound source 11 supplies the second Lch acoustic driving signal LR via the connection wiring pattern 15L to each electrode connected to the connection wiring pattern 15L.

In such arrangement, the multiple individual piezoelectric elements are connected to the acoustic signals of respective channels, so that the sound pressure level to frequency characteristics as described above can be realized for the stereo sound.

Figure 21A:
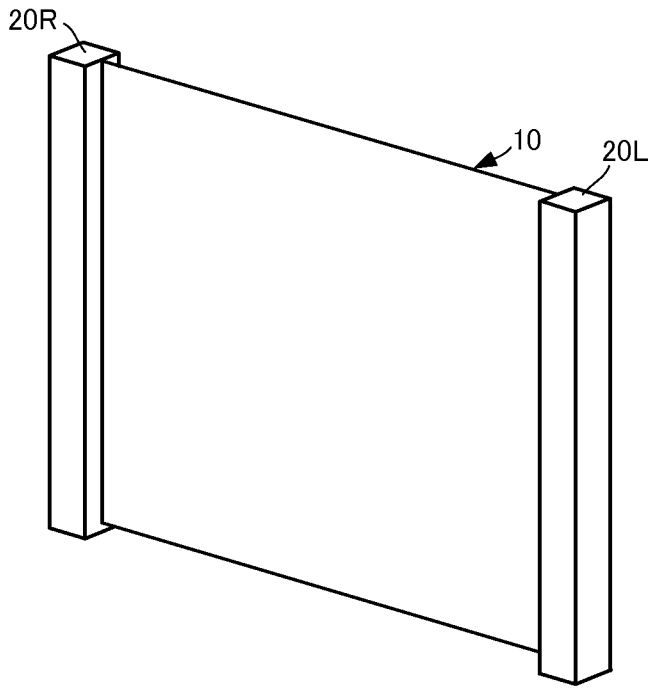
FIGS. 21A and 21B are external perspective views of a piezoelectric speaker apparatus according to a ninth embodiment.
Figure 21B:
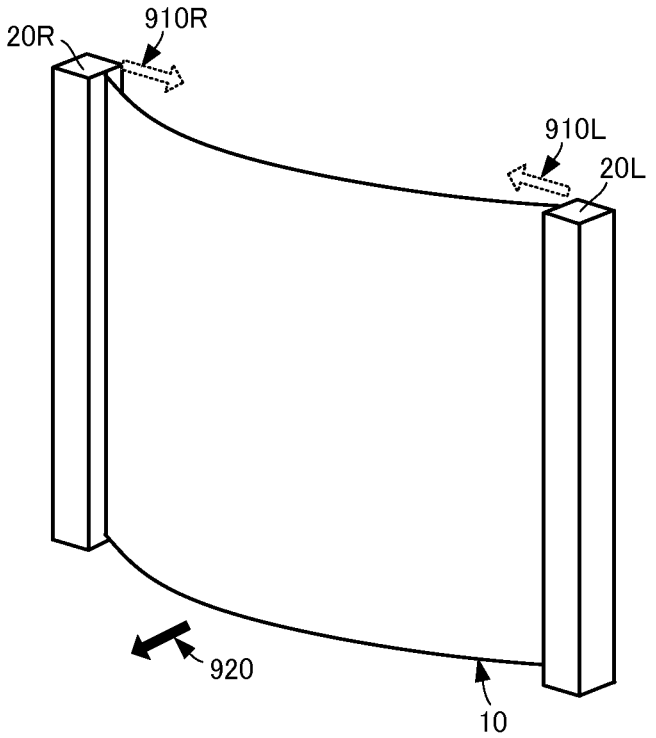
Figure 22A:
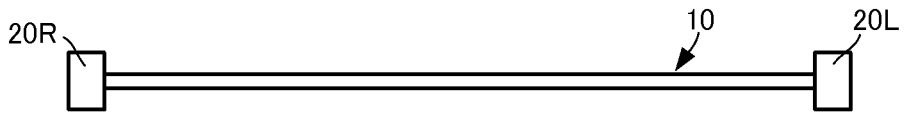
FIGS. 22A and 22B are top views of the piezoelectric speaker apparatus according to the ninth embodiment.
Figure 22B:
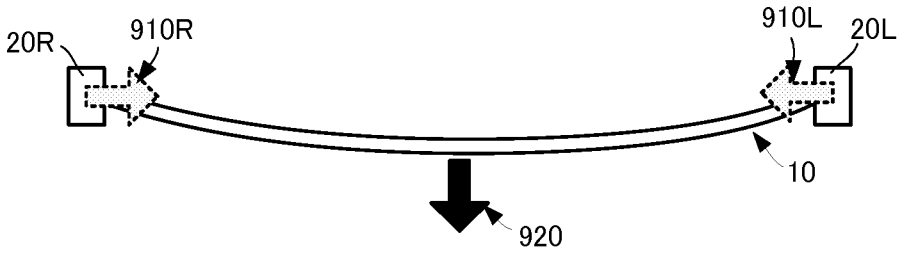

Next, the piezoelectric speaker apparatus according to the ninth embodiment will be described by referring to the drawings. FIGS. 21A and 21B are external perspective views of the piezoelectric speaker apparatus according to the ninth embodiment, in which FIG. 21A illustrates a state where the holding members 20R and 20L are not driven and FIG. 21B illustrates a state where the holding members 20R and 20L are driven. FIGS. 22A and 22B are top views of the piezoelectric speaker apparatus according to the ninth embodiment, in which FIG. 22A illustrates a state where the holding members 20R and 20L are not driven and FIG. 22B illustrates a state where the holding members 20R and 20L are driven.

As illustrated in FIGS. 21A and 21B, in the piezoelectric speaker apparatus of the present invention, pillar-like holding members 20R and 20L are attached to both of the opposing ends of the flat type transparent piezoelectric speaker 10 as illustrated in each of the above-described embodiments. The piezoelectric speaker 10 is held by these holding members 20R and 20L so that its sound emitting plane faces in substantially the horizontal direction.

The holding members 20R and 20L are provided with the function of actuator that is driven by a supplied acoustic driving signal. For example, it is configured to vibrate by an electromagnetic induction generated by the combination of a coil and a magnet. It is noted that the holding members 20R and 20L may be an element with piezoelectricity, electric field distortion, magnetic field distortion, and the like, an ultra sound motor, and so on.

The holding members 20R and 20L are arranged so as to vibrate in the opposite directions with respect to the piezoelectric speaker 10 by an acoustic driving signal. That is, the holding members 20R and 20L push the piezoelectric speaker 10 toward the center at a timing, as illustrated by the symbols 910R and 910L of FIG. 21B and FIG. 22B. Further, at another timing, the holding members 20R and 20L return to the original position. The repetition of these operations causes the piezoelectric speaker 10 to vibrate according to the acoustic driving signal supplied to the holding members 20R and 20L and thus emit sound along the direction orthogonal to the primary surface of the piezoelectric speaker 10 as illustrated by the symbol 920 of FIG. 21B and FIG. 22B. At this time, the sound is emitted to the direction opposite to the symbol 920 illustrated in FIG. 21B and FIG. 22B. However, when the piezoelectric speaker apparatus is disposed on a screen of a display and closed at its display side space, for example, the sound in the direction opposite to the symbol 920 is not emitted to the outside.

Figure 23:
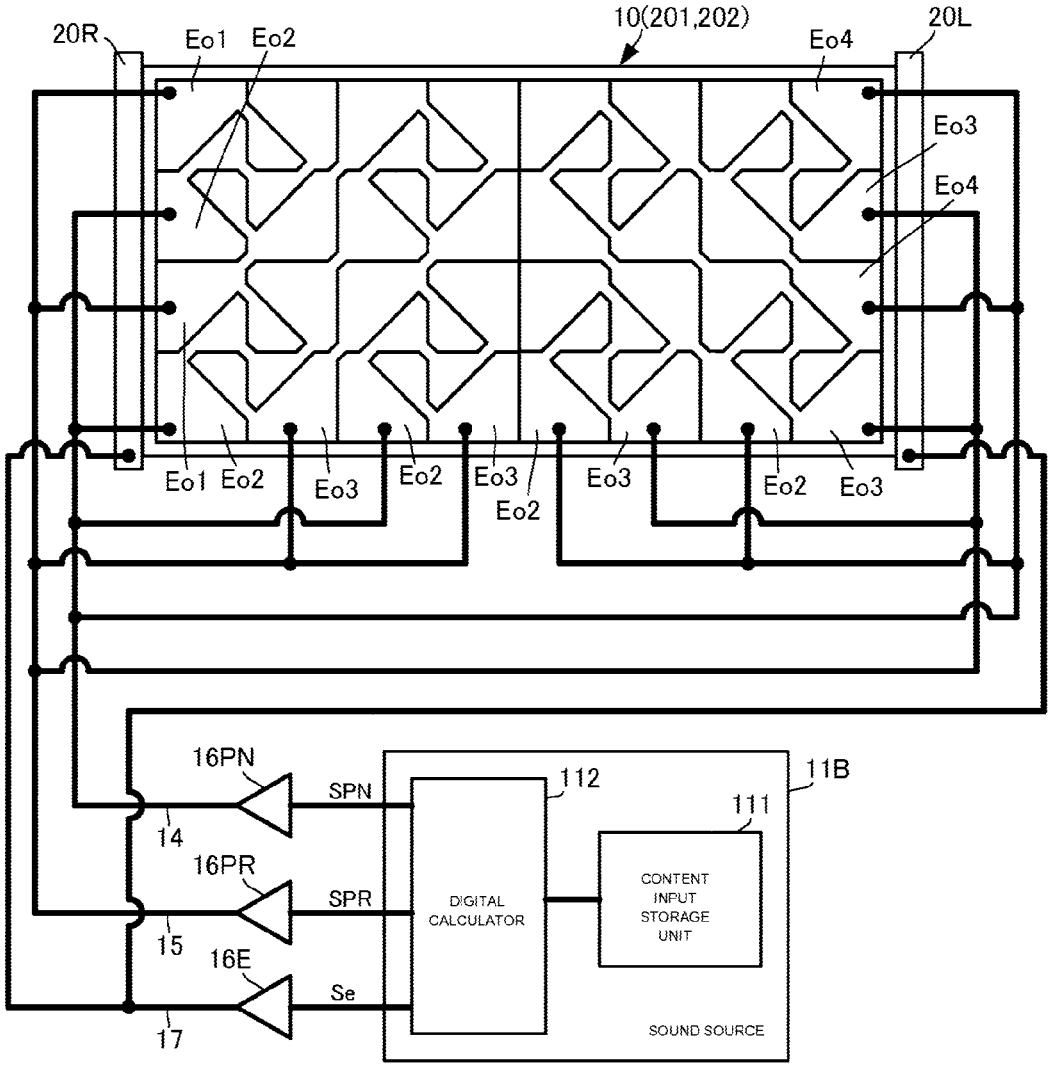
FIG. 23 is a view illustrating a supplying configuration of an acoustic signal to the piezoelectric speaker apparatus according to the ninth embodiment.

The acoustic driving signal is supplied to the piezoelectric speaker apparatus having such arrangement as illustrated in FIG. 23. FIG. 23 is a view illustrating the supplying configuration of the acoustic signal to the piezoelectric speaker apparatus according to the ninth embodiment.

The outer side electrode Eo1 of the individual piezoelectric element Pe11, the outer side electrodes Eo1 and Eo3 of the individual piezoelectric element Pe21, the outer side electrode Eo3 of the individual piezoelectric element Pe22, and the outer side electrodes Eo3 of the individual piezoelectric elements Pe23, Pe24, and Pe14 of the piezoelectric speaker 10 are connected to the sound source 11 via a connection wiring pattern 15 and an amplifier 16PR.

The outer side electrodes Eo2 of the individual piezoelectric elements Pe11, Pe21, Pe22, and Pe23, the outer side electrodes Eo2 and Eo4 of the piezoelectric element Pe24, and the outer side electrode Eo4 of the individual piezoelectric element Pe14 are connected to the sound source 11 via the connection wiring pattern 14 and an amplifier 16PN.

The holding members 20R and 20L are connected to the sound source 11 via a connection wiring pattern 17 and an amplifier 16E.

A sound source 11B has a content input storage unit 111 and a digital calculator 112. The content input storage unit 111 includes a storage medium such as a flush memory in which music content data is stored, a reproducing device for reproducing a music recording medium such as a CD, a device for streaming-reproducing a music content from an outside, and so on.

The digital calculator 112 decodes a music content from the content input storage unit 111 and generates music data to generate an acoustic driving signal for the piezoelectric speaker from the music data, that is, the first acoustic driving signal and the second acoustic driving signal described above. Further, the digital calculator 112 suppresses the upper sound range component of the decoded music data to generate an acoustic driving signal for the holding members that is mainly made of lower sound range components.

The amplifier 16PN amplifies the first acoustic driving signal and supplies it to each electrode of the piezoelectric speaker 10 connected to the connection wiring pattern 14. The amplifier 16PR amplifies the second acoustic driving signal and supplies it to each electrode of the piezoelectric speaker 10 connected to the connection wiring pattern 15.

The amplifier 16E amplifies the acoustic driving signal for the holding members and supplies it to the holding members 20R and 20L connected to the connection wiring pattern 17.

In response to be supplied with the above acoustic driving signals, the piezoelectric speaker 10 emits sound at a sound pressure level to frequency similar to respective embodiments described above. At the same time, the holding members 20R and 20L causes the entire surface of the piezoelectric speaker 10 to mechanically vibrate, so that sound of the lower sound range, which is the main component of the acoustic driving signal for the holding members, is emitted. In particular, the mechanical vibration at the entire surface of the piezoelectric speaker 10 is not likely to follow the supplied acoustic driving signal in the upper sound range, but is able to follow it in the lower sound range and therefore effective. Further, the sound emission area can be larger, so that the sound pressure of the lower sound range can be effectively increased.

This allows for the improved sound pressure in the lower sound range that would otherwise be lower at each embodiment described above. That is, the flat sound pressure level to frequency characteristics can be realized from the lower sound range to the upper sound range.

Figure 24:
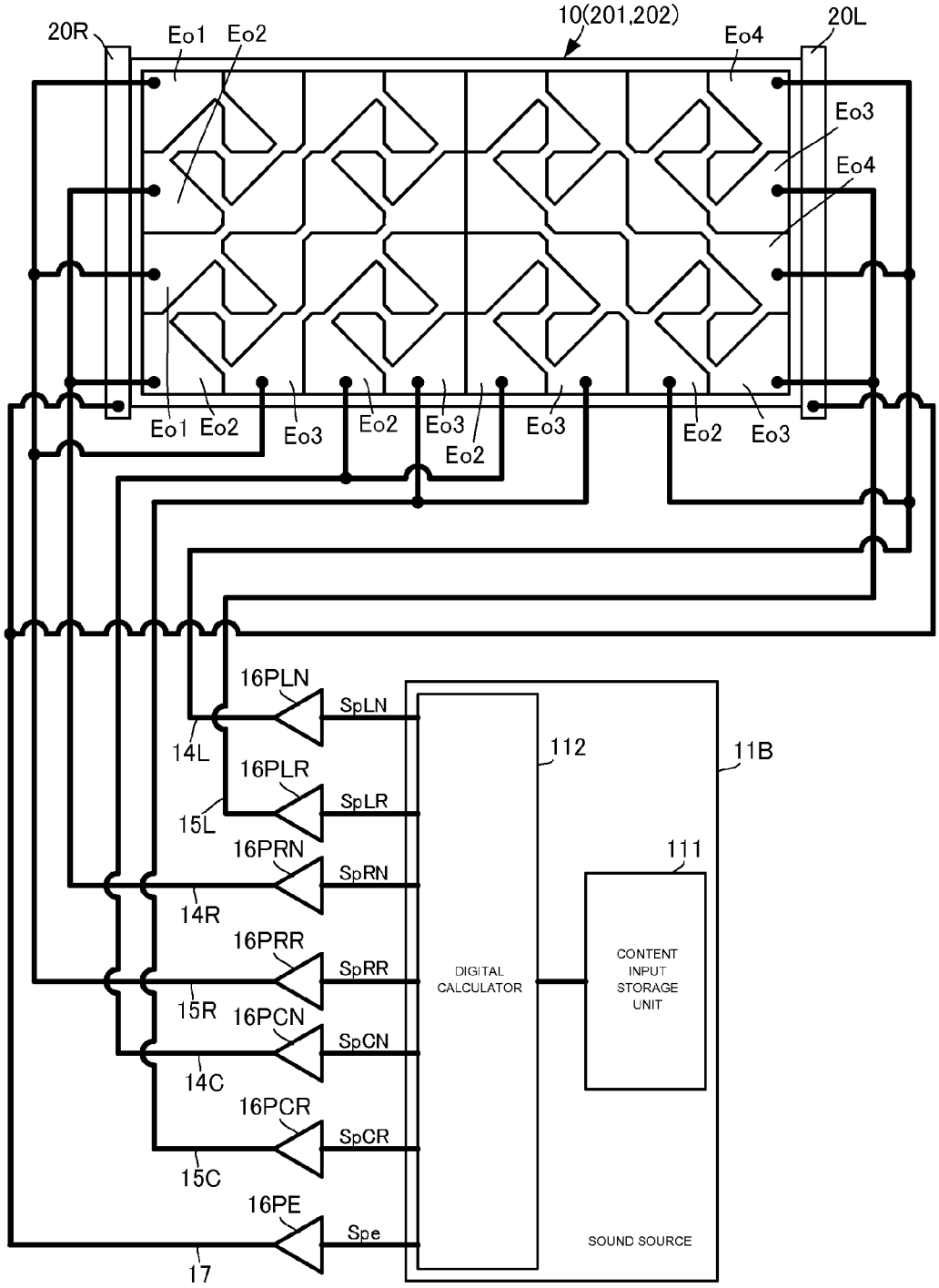
FIG. 24 is a wiring diagram for implementing the 3.1 channel surround.

It is noted that, when it is configured to supply bass sound to such holding members, the 2.1 channel surround and the 3.1 channel surround can also be implemented. FIG. 24 is a wiring diagram for implementing the 3.1 channel surround. In FIG. 24, the piezoelectric speaker 10 illustrated in the first embodiment is employed similarly to FIG. 23. Further, the fundamental connection arrangement is similar to the eighth and ninth embodiments described above and thus the description thereof will be omitted.

As illustrated in FIG. 24, in the digital calculator of the sound source 11B, the L channel acoustic driving signal, the R channel acoustic driving signal, the C channel acoustic driving signal, and the bass acoustic signal are generated from the 3.1 ch music content (it is similar for the sound for video content).

A first L channel acoustic driving signal and a second L channel acoustic driving signal of the L channel acoustic driving signal are amplified by the amplifier 16PLN and 16PLR and supplied from the individual piezoelectric elements Pe14 and Pe24.

A first R channel acoustic driving signal and a second R channel acoustic driving signal of the R channel acoustic driving signal are amplified by amplifiers 16PRN and 16PRR and supplied from the individual piezoelectric elements Pe11 and Pe21.

A first L channel acoustic driving signal and a second L channel acoustic driving signal of the C channel acoustic driving signal are amplified by amplifiers 16PCN and 16PCR and supplied from the individual piezoelectric elements Pe22 and Pe23.

The bass acoustic driving signal is amplified by the amplifier 16E and supplied to the holding members 20R and 20L.

The use of such supplying configuration of the acoustic driving signal causes the individual piezoelectric elements Pe11 and Pe21 to mainly emit the sound of the R channel sound and causes the individual piezoelectric elements Pe14 and Pe24 to mainly emit the sound of the L channel sound. Further, the individual piezoelectric elements Pe12, Pe22, Pe13, and Pe23 mainly emit the sound of the C channel sound. Further, the piezoelectric speaker 10 as a whole emits the sound of the bass acoustic signal.

As such, the use of the arrangement of FIG. 24 allows for easy implementation of the 3.1 ch surround while exhibiting the features of respective elements of the piezoelectric speaker apparatus.

It is noted that, in FIG. 24, since the individual piezoelectric elements Pe11, Pe21, Pe12, and Pe22 are connected, the C channel sound may be auxiliary emitted from the individual piezoelectric elements Pe11 and Pe21 and the R channel sound may be auxiliary emitted from the individual piezoelectric elements Pe12 and Pe22. Similarly, since the individual piezoelectric elements Pe13, Pe23, Pe14, and Pe24 are connected, the C channel sound may be auxiliary emitted from the individual piezoelectric elements Pe14 and Pe24 and the L channel sound may be auxiliary emitted from the individual piezoelectric elements Pe13 and Pe23. This allows for realizing further sophisticated sound pressure level to frequency characteristics.

In this case, the individual piezoelectric elements Pe12 and Pe22, the individual piezoelectric elements Pe12, Pe22, Pe13, and Pe23, and individual piezoelectric elements Pe14 and Pe24 may of course be driven independently.

Further, although the example using the piezoelectric speaker 10 of the first embodiment has been described in FIG. 23 and FIG. 24 described above, the piezoelectric speaker of other embodiments may of course be employed. As such, the appropriate combination of the arrangements of respective embodiments described above allows for a flat type transparent speaker that has a high sound pressure level and realizes a desired sound pressure level to frequency characteristics.

Further, although the example of a flat type transparent speaker has been described in respective embodiments described above, the high sound pressure level and the desired sound pressure level to frequency characteristics can be realized for a flat type speakers in which other materials are used.

Further, although the example that the piezoelectric speaker is implemented in the bimorph structure has been described in respective embodiments described above, the similar effect and advantage can also be obtained in the unimorph structure. Further, although the example that the same electrode patterns are formed in both sides of the polymer sheet has been described, the electrode on the surface opposite to the sound emitting surface may be the ground electrode.

DESCRIPTION OF REFERENCE SYMBOLS

10: piezoelectric speaker
11, 11A, 11B: sound source
14, 15, 14R, 14L, 15R, 15L, 17: connection wiring pattern
16PN, 16PR, 16E: amplifier
20R, 20L: holding member
100: base member
201: first piezoelectric speaker
202: second piezoelectric speaker
210, 220: polymer sheet
211, 212, 221, 222: electrode pattern
301, 302: protection sheet
EA0: fundamental electrode pattern
Ei1, Ei2, Ei3, Ei4: inner side electrode
Eo1, Eo2, Eo3, Eo4: outer side electrode
Pe11 to Pe14, Pe21 to Pe24, Pe11A to Pe15A, Pe21A to Pe25A, Pe31A to Pe35A, Pe11B to Pe14B, Pe21B to Pe24B, Pe31, Pe32, Pe33, Pe11C to Pe15C, Pe21C to Pe25C, Pe31C to Pe35C, Pe311, Pe312, Pe313, Pe314, Pe321, Pe322, Pe323, Pe324, Pe11D to Pe14D, Pe21D to Pe24D, Pe11E to Pe14E, Pe21E to Pe24E, Pe11F to Pe14F, Pe21F to Pe24F: individual piezoelectric element

The invention claimed is:

1. A piezoelectric speaker comprising:

a piezoelectric polymer sheet having opposed first and second surfaces;

a first electrode pattern on the first surface of the piezoelectric polymer sheet; and a second electrode pattern on the second surface of the piezoelectric polymer sheet, wherein the first and second electrode patterns are adapted to apply an electric field to the piezoelectric polymer sheet, and wherein the first and second electrode patterns are configured to form a plurality of individual piezoelectric elements that each individually vibrate based on a single acoustic driving signal.

2. The piezoelectric speaker according to claim 1, wherein an electrode of the individual piezoelectric elements is divided into four by a first dividing line along an extending direction of the piezoelectric polymer sheet and a second dividing line orthogonal to the first dividing line to form a divided electrode, each divided electrode is further divided into first and second electrode parts, the first electrode part being arranged in a center side of the individual piezoelectric element, and the second electrode part being arranged in a peripheral region of the individual piezoelectric element.

3. The piezoelectric speaker according to claim 2, wherein shapes of the first electrode part and the second electrode part of at least one individual piezoelectric element of the plurality of individual piezoelectric elements are different from shapes of the first electrode part and the second electrode part of another individual piezoelectric element.

4. The piezoelectric speaker according to claim 2, wherein a first area ratio of the first electrode part to the second electrode part of at least one individual piezoelectric element of the plurality of individual piezoelectric elements is different from a second area ratio of the first electrode part to the second electrode part of another individual piezoelectric element.

5. The piezoelectric speaker according to claim 2, wherein the first and second electrode parts are divided by a third dividing line that is in the shape of an asteroid curve that is convex toward the first electrode part.

6. The piezoelectric speaker according to claim 1, wherein a primary component of the piezoelectric polymer sheet is an L-isomer polylactic acid.

7. The piezoelectric speaker according to claim 6, wherein the first and second electrode patterns are transparent electrodes and refractive indices of the transparent electrodes and that of the piezoelectric polymer sheet are substantially the same.

8. The piezoelectric speaker according to claim 7, wherein the transparent electrodes include at least one of indium tin oxide, indium zinc oxide, zinc oxide, polythiophene and polyaniline as a primary component thereof.

9. The piezoelectric speaker according to claim 1, wherein the individual piezoelectric elements are aligned such that at least four are in a longitudinal direction and at least two are in a width direction with respect to the piezoelectric polymer sheet.

10. A piezoelectric speaker comprising:

a base member having a first and second opposed sides;

a first speaker element on the first side of the base member, the first speaker element including:

a first piezoelectric polymer sheet having opposed first and second surfaces;

a first electrode pattern on the first surface of the first piezoelectric polymer sheet; and a second electrode pattern on the second surface of the first piezoelectric polymer sheet, wherein the first and second electrode patterns are adapted to apply an electric field to the first piezoelectric polymer sheet, and wherein the first and second electrode patterns are configured to form a first plurality of individual piezoelectric elements that each individually vibrate based on a single acoustic driving signal; and a second speaker element on the second side of the base member, the second speaker element including:

a second piezoelectric polymer sheet having opposed third and fourth surfaces;

a third electrode pattern on the third surface of the second piezoelectric polymer sheet; and a fourth electrode pattern on the fourth surface of the second piezoelectric polymer sheet, wherein the third and fourth electrode patterns are adapted to apply an electric field to the second piezoelectric polymer sheet, and wherein the third and fourth electrode patterns are configured to form a second plurality of individual piezoelectric elements that each individually vibrate based on the single acoustic driving signal, and wherein the first and second piezoelectric polymer sheets are arranged so as to hold the base member such that the first and second plurality of individual piezoelectric elements correspond to each other when the piezoelectric speaker is viewed from a direction orthogonal to the first and second opposed sides of the base member.

11. The piezoelectric speaker according to claim 10, further comprising:

a first protection sheet arranged on a surface of the first speaker element opposite to the base member; and a second protection sheet arranged on a surface of the second speaker element opposite to the base member.

12. The piezoelectric speaker according to claim 10, further comprising:

a holding member adapted to hold the base member and vibrate based on the single acoustic driving signal; and a driving unit adapted to apply a particular sound range component of the single acoustic driving signal to the holding member.

13. The piezoelectric speaker according to claim 10, wherein a respective electrode of the first and second plurality of individual piezoelectric elements is divided into four by a first dividing line along an extending direction of the first and second piezoelectric polymer sheets, respectively, and a second dividing line orthogonal to the first dividing line to form divided electrodes, each of the divided electrodes is further divided into respective first and second electrode parts, the first electrode parts being arranged in a center side of the individual piezoelectric element thereof, and the second electrode parts being arranged in a peripheral region of the individual piezoelectric element thereof.

14. The piezoelectric speaker according to claim 13, wherein shapes of the first electrode part and the second electrode part of at least one individual piezoelectric element of the first and second plurality of individual piezoelectric elements are different from shapes of a first electrode part and a second electrode part of another individual piezoelectric element.

15. The piezoelectric speaker according to claim 13, wherein a first area ratio of the first electrode part to the second electrode part of at least one individual piezoelectric element of the first and second plurality of individual piezoelectric elements are different from a second area ratio of a first electrode part to a second electrode part of another individual piezoelectric element.

16. The piezoelectric speaker according to claim 13, wherein the first and second electrode parts are divided by a third dividing line that is in the shape of an asteroid curve that is convex toward the first electrode parts.

17. The piezoelectric speaker according to claim 10, wherein a primary component of the first and second piezoelectric polymer sheets is an L-isomer polylactic acid.

18. The piezoelectric speaker according to claim 17, wherein the first, second, third and fourth electrode patterns are transparent electrodes and refractive indices of the transparent electrodes and that of the first and second piezoelectric polymer sheets are substantially the same.

19. The piezoelectric speaker according to claim 18, wherein the transparent electrodes include at least one of indium tin oxide, indium zinc oxide, zinc oxide, polythiophene and polyaniline as a primary component thereof.

20. The piezoelectric speaker according to claim 10, wherein the first and second plurality of individual piezoelectric elements are aligned such that at least four of the first and second plurality of individual piezoelectric elements are in a longitudinal direction and at least two the first and second plurality of individual piezoelectric elements are in a width direction with respect to the first and second piezoelectric polymer sheets.

* * * * *